US011525427B2

(12) United States Patent
Yamamoto et al.

(10) Patent No.: US 11,525,427 B2
(45) **Date of Patent: *Dec. 13, 2022**

(54) HIGH PRESSURE FUEL PUMP AND FUEL SUPPLY SYSTEM

(71) Applicant: DENSO CORPORATION, Kariya (JP)

(72) Inventors: Shuhei Yamamoto, Kariya (JP); Kazuhiro Onishi, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/246,804

(22) Filed: May 3, 2021

(65) Prior Publication Data

US 2021/0254588 A1 Aug. 19, 2021

Related U.S. Application Data

(63) Continuation of application No. 15/962,210, filed on Apr. 25, 2018, now Pat. No. 11,028,809.

(30) Foreign Application Priority Data

Jun. 22, 2017 (JP) ..... JP2017-122433
Jan. 15, 2018 (JP) ..... JP2018-4238

(51) Int. Cl.
*F02M 59/06* (2006.01)
*F02M 63/00* (2006.01)
(Continued)

(52) U.S. Cl.
CPC ..... *F02M 59/06* (2013.01); *F02M 37/18* (2013.01); *F02M 59/34* (2013.01);
(Continued)

(58) Field of Classification Search
CPC ..... F02M 59/06; F02M 59/34; F02M 59/368; F02M 59/44; F02M 37/18;
(Continued)

(56) References Cited

U.S. PATENT DOCUMENTS 5,598,817 A 2/1997 Igarashi
6,016,790 A * 1/2000 Makino ..... F02M 59/06 123/496
(Continued)

FOREIGN PATENT DOCUMENTS

DE 10-2007-002729 6/2008
DE 10-2007-038523 2/2009
(Continued)

*Primary Examiner* — James G Moubry
(74) *Attorney, Agent, or Firm* — Nixon & Vanderhye P.C.

(57) ABSTRACT

A high pressure fuel pump includes: a pump body that forms a suction passage and a pressurizing chamber and slidably supports a plunger; and a control valve that opens a connection between the suction passage and the pressurizing chamber in a suction stroke, during which the plunger is driven toward a suction side for suctioning fuel into the pressurizing chamber, while the control valve controls closing timing, at which the connection between the suction passage and the pressurizing chamber is closed by the control valve in a delivery stroke, during which the plunger is driven toward a delivery side for delivering the fuel out of the pressurizing chamber. The pump body forms a release passage that is communicated with the suction passage. The release passage relieves the fuel, which is pressurized by the plunger, from the pressurizing chamber before the closing timing during the delivery stroke.

6 Claims, 29 Drawing Sheets

(51) Int. Cl.

| | |
|---|---|
| ***F02M 63/02*** | (2006.01) |
| ***F02M 59/36*** | (2006.01) |
| ***F02M 59/34*** | (2006.01) |
| ***F02M 59/44*** | (2006.01) |
| ***F02M 37/18*** | (2006.01) |
| *F02M 37/00* | (2006.01) |

(52) U.S. Cl.
CPC ..... *F02M 59/368* (2013.01); *F02M 59/44* (2013.01); *F02M 63/0022* (2013.01); *F02M 63/0265* (2013.01); *F02M 37/0047* (2013.01)

(58) Field of Classification Search
CPC ..... F02M 37/0047; F02M 37/46; F02M 63/0001; F02M 63/0022; F02M 63/0265; F02M 55/00
See application file for complete search history.

(56) References Cited

U.S. PATENT DOCUMENTS

| | | | | |
|---|---|---|---|---|
| 6,065,436 | A | 5/2000 | Koga | |
| 6,131,548 | A | 10/2000 | Yano | |
| 6,196,191 | B1 | 3/2001 | Rembold | |
| 6,336,445 | B1 | 1/2002 | Yamazaki | |
| 6,345,608 | B1 | 2/2002 | Rembold et al. | |
| 6,694,952 | B1 | 2/2004 | Yamazaki et al. | |
| 6,722,857 | B1 | 4/2004 | Kellner | |
| 6,739,317 | B2 | 5/2004 | Kellner | |
| 7,389,766 | B2 | 6/2008 | Akita | |
| 10,890,177 | B2 * | 1/2021 | Hagihara | F02M 63/004 |
| 2003/0029423 | A1 | 2/2003 | Boehland | |
| 2006/0159555 | A1 | 7/2006 | Inoue | |
| 2009/0064971 | A1 | 3/2009 | Ricco et al. | |
| 2009/0104045 | A1 | 4/2009 | Inoue | |
| 2009/0185923 | A1 * | 7/2009 | Sato | F02M 59/464 417/545 |
| 2009/0277424 | A1 * | 11/2009 | Yonemoto | F02M 37/0052 123/506 |
| 2010/0074782 | A1 | 3/2010 | Inoue | |
| 2010/0074783 | A1 | 3/2010 | Inoue | |
| 2010/0307460 | A1 * | 12/2010 | Matsuki | F02M 59/102 123/511 |
| 2014/0224217 | A1 | 8/2014 | Pursifull | |
| 2015/0152829 | A1 | 6/2015 | Koenig | |
| 2016/0377016 | A1 | 12/2016 | Ulrey | |
| 2017/0306880 | A1 | 10/2017 | Nakaoka | |
| 2018/0372048 | A1 | 12/2018 | Yamamoto | |

FOREIGN PATENT DOCUMENTS

| | | |
|---|---|---|
| DE | 102014211472 | 12/2015 |
| JP | 2009-243416 | 10/2009 |
| JP | 2009-257200 | 11/2009 |
| JP | 2012-219758 | 11/2012 |
| WO | 2009080425 | 7/2009 |

* cited by examiner

HIGH PRESSURE FUEL PUMP AND FUEL SUPPLY SYSTEM

CROSS REFERENCE TO RELATED APPLICATION

This is a continuation application of U.S. application Ser. No. 15/962,210, filed Apr. 25, 2018, which claims priority to and incorporates herein by reference Japanese Patent Application No. 2017-122433 filed on Jun. 22, 2017 and Japanese Patent Application No. 2018-004238 filed on Jan. 15, 2018.

TECHNICAL FIELD

The present disclosure relates to a high pressure fuel pump and a fuel supply system having the high pressure fuel pump.

BACKGROUND

Previously, a high pressure fuel pump is widely used in, for example, a fuel supply system of an internal combustion engine while the high pressure fuel pump is configured to deliver fuel, which is suctioned into a pressurizing chamber from a low pressure fuel pump through a suction passage, to a supply destination after pressurizing the fuel in the pressurizing chamber with a plunger.

With respect to the high pressure fuel pump of the positive displacement type discussed above, JP2002-521616A (corresponding to U.S. Pat. No. 6,345,608B1) discloses a technique of controlling closing timing, which is timing of closing a connection between the suction passage and the pressurizing chamber in a delivery stroke, by using a control valve. Here, the delivery stroke is defined as a stroke, in which the plunger is driven toward a delivery side for delivering the fuel out of the pressurizing chamber upon pressurization of the fuel. According to the disclosed technique of JP2002-521616A (corresponding to U.S. Pat. No. 6,345,608B1), the fuel of the pressurizing chamber is pressurized by the plunger and is returned to the suction passage before the closing timing during the delivery stroke for delivering the fuel out of the pressurizing chamber upon pressurization. With respect to this point, according to the disclosed technique of JP2002-521616A (corresponding to U.S. Pat. No. 6,345,608B1), the amount of returned fuel, which is returned from the pressurizing chamber to the suction passage, can be highly accurately controlled by changing the amount of returned fuel through the control of the closing timing.

However, it is found that the energy, which is used to suction the fuel from the low pressure fuel pump into the pressurizing chamber through the suction passage, is excessively lost according to the technique disclosed in JP2002-521616A (corresponding to U.S. Pat. No. 6,345,608B1). Hereinafter, this disadvantage will be described.

First of all, at a time point, which is before the closing timing during the delivery stroke, as shown in FIG. 29A, the fuel is returned from the pressurizing chamber 1000 to the suction passage 1001, so that a backflow of the fuel is generated in the suction passage 1001. Next, at a time point, which is after the closing timing during the delivery stroke, as shown in FIG. 29B, the return of the fuel is stopped between the pressurizing chamber 1000, which is closed, and the suction passage 1001, while the backflow of the fuel, which is generated before the closing timing, is continued by inertia in the suction passage 1001.

In this backflow generating state, when the suction stroke starts, as shown in FIG. 29C, the connection between the suction passage 1001 and the pressurizing chamber 1000 is opened by the control valve 1002, and the plunger 1003 is driven toward the suction side for suctioning the fuel into the pressurizing chamber 1000. However, in the suction passage 1001, which is in the backflow generating state, the fuel is less likely moved toward the pressurizing chamber 1000. Therefore, in order to fill the fuel into the pressurizing chamber 1000 through the suctioning of the fuel in the suction stroke during the limited time period, a high fuel pressure, which can counteract the backflow, need to be applied at the low pressure fuel pump 1004. Therefore, the energy for suctioning the fuel into the pressurizing chamber 1000 through the suction passage 1001 is excessively required at the low pressure fuel pump 1004, and thereby this technique is not desirable.

SUMMARY

The present disclosure is made in view of the above disadvantage, and it is an objective of the present disclosure to provide a high pressure fuel pump and a fuel supply system, which can limit the energy loss.

Hereinafter, a technical means of the present disclosure for achieving the above objective will be described.

According to a first aspect of the present disclosure, there is provided a high pressure fuel pump for delivering fuel, which is suctioned into a pressurizing chamber from a low pressure fuel pump through a suction passage, to a supply destination after pressurizing the fuel in the pressurizing chamber with a plunger, the high pressure fuel pump comprising: a pump body that forms the suction passage and the pressurizing chamber and slidably supports the plunger; and a control valve that opens a connection between the suction passage and the pressurizing chamber in a suction stroke, during which the plunger is driven toward a suction side for suctioning the fuel into the pressurizing chamber, while the control valve controls closing timing, at which the connection between the suction passage and the pressurizing chamber is closed by the control valve in a delivery stroke, during which the plunger is driven toward a delivery side for delivering the fuel out of the pressurizing chamber upon pressurization of the fuel, wherein: the pump body forms a release passage that is communicated with the suction passage; and the release passage relieves the fuel, which is pressurized by the plunger, from the pressurizing chamber before the closing timing during the delivery stroke.

Furthermore, according to a second aspect of the present disclosure, there is provided a fuel supply system comprising: a low pressure fuel pump that delivers fuel; and a high pressure fuel pump that delivers the fuel, which is suctioned into a pressurizing chamber from the low pressure fuel pump through a suction passage, to a supply destination after pressurizing the fuel in the pressurizing chamber with a plunger, wherein the high pressure fuel pump includes: a pump body that forms the suction passage and the pressurizing chamber and slidably supports the plunger; and a control valve that opens a connection between the suction passage and the pressurizing chamber in a suction stroke, during which the plunger is driven toward a suction side for suctioning the fuel into the pressurizing chamber, while the control valve controls closing timing, at which the connection between the suction passage and the pressurizing chamber is closed by the control valve in a delivery stroke, during which the plunger is driven toward a delivery side for delivering the fuel out of the pressurizing chamber upon pressurization of the fuel, wherein: the pump body forms a release passage that is communicated with the suction passage; and the release passage relieves the fuel, which is pressurized by the plunger, from the pressurizing chamber before the closing timing during the delivery stroke.

Before the closing timing during the delivery stroke according to the first and second aspects of the present disclosure, the fuel, which is pressurized by the plunger, tends to return from the pressurizing chamber to the suction passage. However, this fuel is relieved into the release passage communicated with the suction passage, so that the generation of the backflow of the fuel in the suction passage can be alleviated. Therefore, the returning of the fuel is limited at the connection between the pressurizing chamber and the suction passage after the closing timing during the delivery stroke of the first embodiment, so that the generation of the backflow of the fuel at the suction passage can be alleviated continuously since the time before the closing timing. In this way, the suction passage, in which the generation of the backflow can be alleviated at the time of starting the suction stroke in the first and second aspects of the present disclosure, is in the forward flow generating state where the flow of the fuel from the low pressure fuel pump toward the pressurizing chamber is eased. In this forward flow generating state, the fuel pressure for filling the fuel into the pressurizing chamber through the suctioning of the fuel at the suction stroke with the limited time period, and the energy for suctioning the fuel into the pressurizing chamber through the suction passage can be minimized at the low pressure fuel pump. Thereby, the energy loss can be limited.

BRIEF DESCRIPTION OF THE DRAWINGS

The present disclosure, together with additional objectives, features and advantages thereof, will be best understood from the following description, the appended claims and the accompanying drawings in which:

DETAILED DESCRIPTION

Hereinafter, various embodiments of the present disclosure will be described with reference to the accompanying drawings. In the following respective embodiments, similar structural elements are indicated by the same reference signs and may not be redundantly described. In a case where only a part of a structure is described in each of the following embodiments, the rest of the structure of the embodiment may be the same as that of previously described one or more of the embodiments. Besides the explicitly described combination(s) of structural components in each of the following embodiments, the structural components of different embodiments may be partially combined even though such a combination(s) is not explicitly described as long as there is no problem.

First Embodiment

Figure 1:
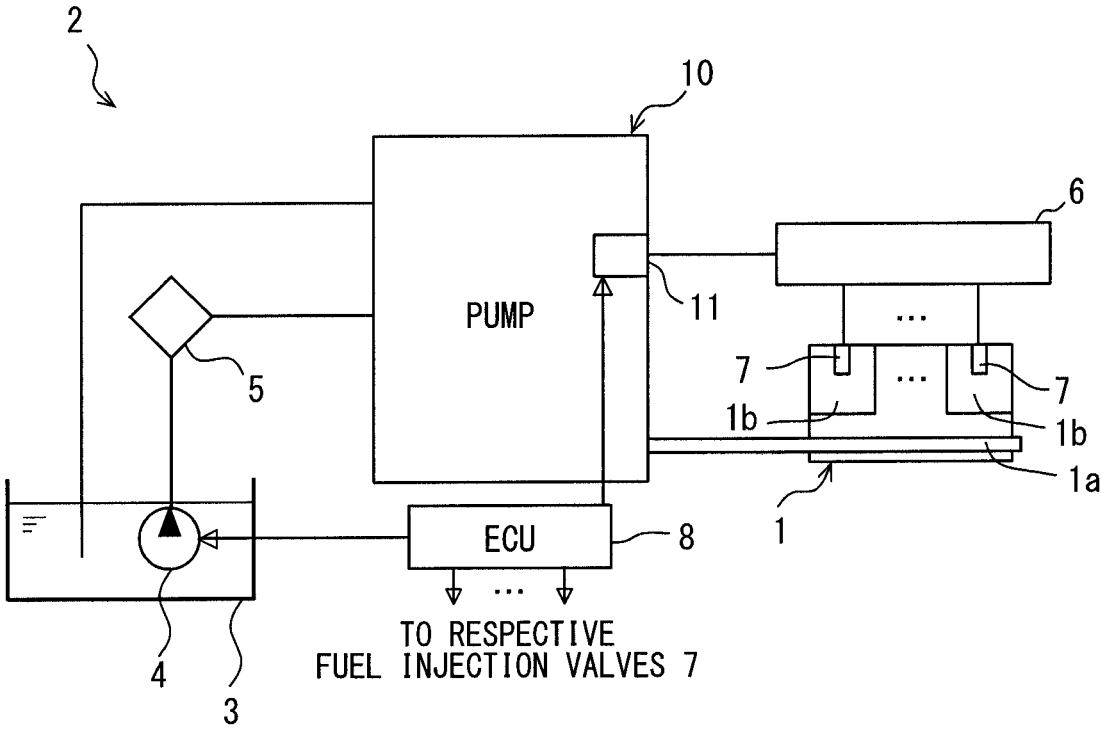
FIG. 1 is a structural diagram indicating a fuel supply system of an internal combustion engine, in which a high pressure fuel pump of a first embodiment is applied.
Figure 2:
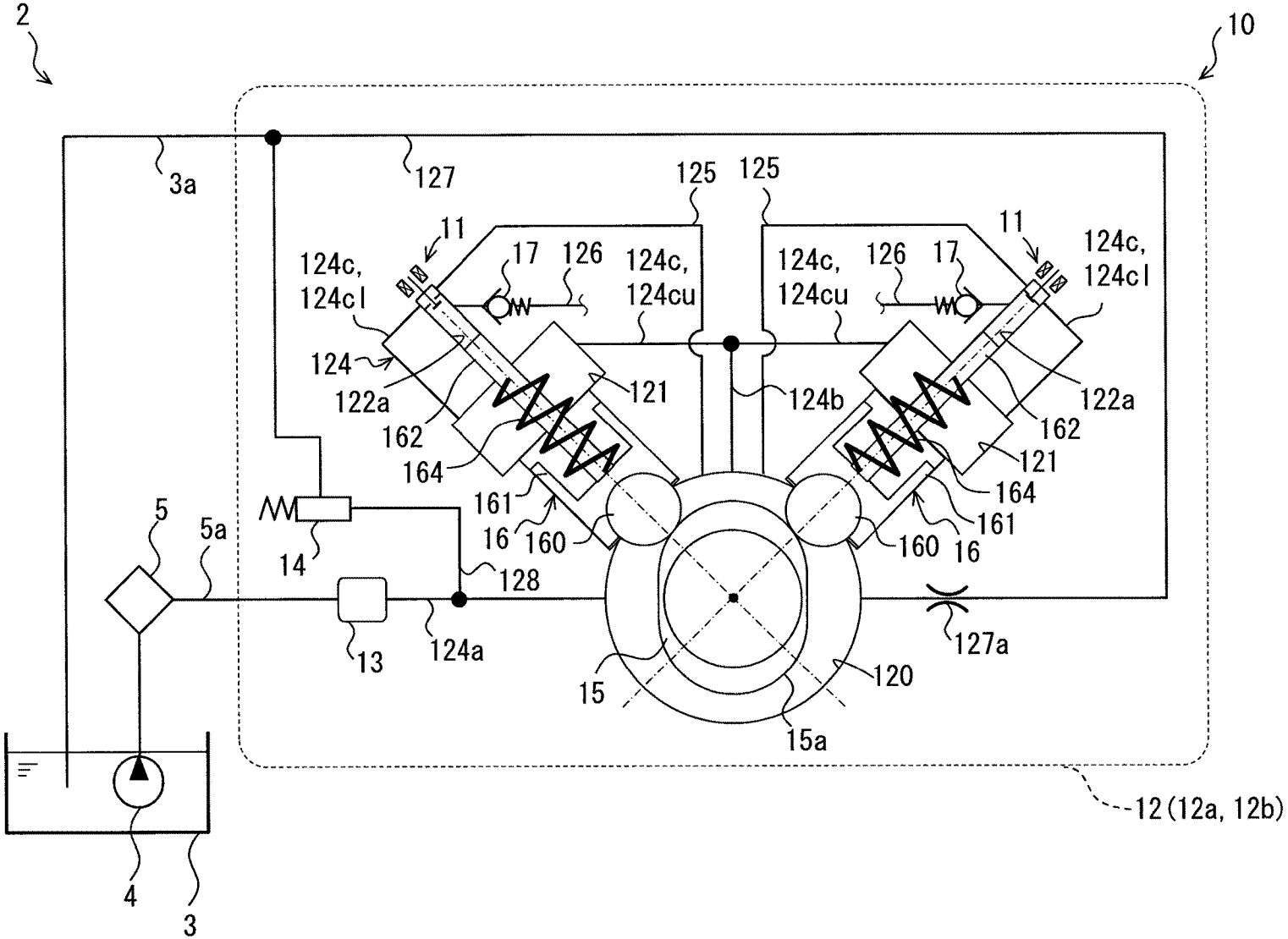
FIG. 2 is a structural diagram indicating the high pressure fuel pump of the first embodiment.

As shown in FIGS. 1 and 2, a high pressure fuel pump 10 of a first embodiment of the present disclosure is applied to a fuel supply system 2 of an internal combustion engine 1 installed to a vehicle (e.g., an automobile). The fuel supply system 2 includes a fuel tank 3, a low pressure fuel pump 4, a low pressure filter 5, a high pressure fuel pump 10, a common rail 6, a plurality of fuel injection valves 7 and an electronic control unit (ECU) 8 to supply light oil (serving as fuel) to a diesel engine (serving as the internal combustion engine 1).

The fuel tank 3 stores fuel to be supplied to the internal combustion engine 1. The low pressure fuel pump 4 is an electric pump that is driven by supplying the electric power to the electric pump. The low pressure fuel pump 4 suctions the fuel in the inside of the fuel tank 3. The low pressure fuel pump 4 pressurizes the suctioned fuel to a predetermined low pressure value (e.g., about 0.4 MPa) and then discharges the pressurized fuel to feed the fuel to the high pressure fuel pump 10 that is located at an outside of the fuel tank 3. The low pressure filter 5 has a filter element, which is placed in an inside of the low pressure filter 5 and filters the fuel that is discharged from the low pressure fuel pump 4. In this way, the low pressure filter 5 captures foreign objects, which are mixed in the fuel at the time of feeding the fuel from the inside of the fuel tank 3 to the low pressure filter 5.

The high pressure fuel pump 10 is a mechanical pump that is driven by a crank torque outputted from a crankshaft 1*a* of the internal combustion engine 1. The high pressure fuel pump 10 suctions the fuel, which is pumped from the low pressure fuel pump 4 and is filtered through the low pressure filter 5. The high pressure fuel pump 10 pressurizes the suctioned fuel to a predetermined high pressure value (e.g., about 250 MPa) and then discharges the pressurized fuel to deliver the fuel to the common rail 6 (serving as a supply destination). At the high pressure fuel pump 10, a fuel delivery amount (i.e., a fuel discharge amount), which is discharged from the high pressure fuel pump 10, is controlled by supplying the electric power to each of a plurality of control valves 11 that are installed in the high pressure fuel pump 10.

The common rail 6 shown in FIG. 1 stores the fuel, which is pumped from the high pressure fuel pump 10 to the common rail 6, in a pressure accumulation chamber of the common rail 6 in a pressurized state. The fuel injection valves 7 are provided to a plurality of cylinders 1*b*, respectively, of the internal combustion engine 1. The fuel is distributed from the common rail 6 to the respective fuel injection valves 7. Each fuel injection valve 7 injects the fuel into a combustion chamber of the corresponding cylinder 1*b* when the electric power is supplied to the fuel injection valve 7 to drive the same.

The ECU 8, which is also referred to as a control device or a controller, includes a microcomputer as a main component thereof. The ECU 8 is connected to the low pressure fuel pump 4, the control valves 11 of the high pressure fuel pump 10, and the fuel injection valves 7. The ECU 8 controls the operation of these connected subjects 4, 11, 7, which are connected to the ECU 8.

Figure 3:
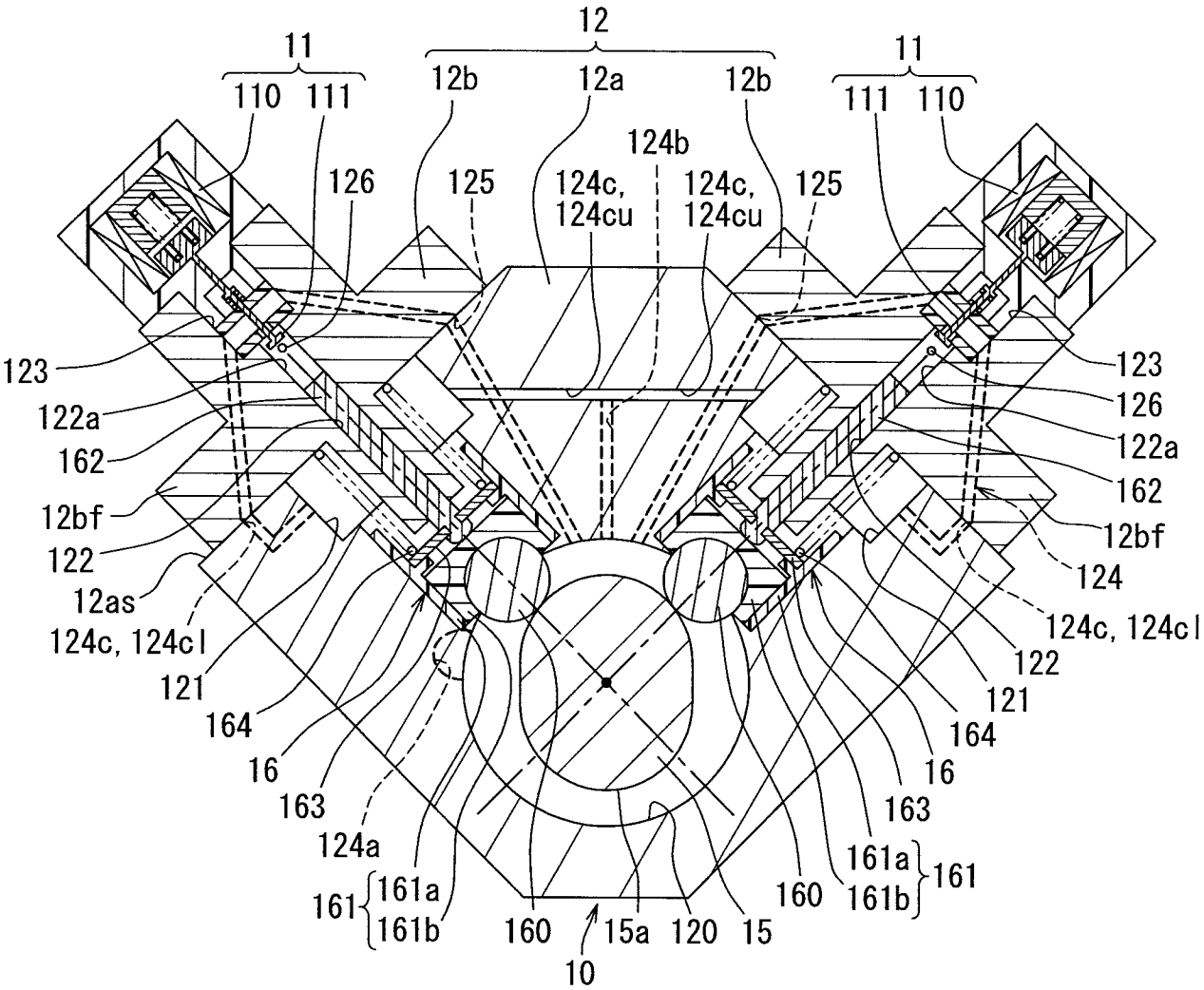
FIG. 3 is a cross-sectional view indicating the high pressure fuel pump of the first embodiment.

The high pressure fuel pump 10, which is applied to the fuel supply system 2, includes a pump body 12, a pump filter 13, a relief valve 14, a drive cam 15, a plurality of movable units 16, a plurality of discharge valves 17 and the plurality of control valves 11, as shown in FIGS. 2 and 3. The pump body 12 includes a casing 12*a* and a plurality of cylinders 12*b*.

The casing 12*a* is made of metal and is formed in a form of a hollow block. The casing 12*a* forms a cam receiving chamber 120 and a plurality of internal pressure variable chambers 121. The cam receiving chamber 120 is formed in a form of a cylindrical hole. In the present embodiment, the number of the internal pressure variable chambers 121 is two (i.e., there is provided a pair of internal pressure variable chambers 121). The internal pressure variable chambers 121 are respectively configured in a form of a cylindrical hole such that central axes of the internal pressure variable chambers 121 are perpendicular to a central axis of the cam receiving chamber 120 and intersect with each other at substantially a right angle. Each internal pressure variable chamber 121 extends from an outer peripheral portion of the cam receiving chamber 120 to an outer surface 12*as* of the casing 12*a*.

As shown in FIG. 3, the number of the cylinders 12*b* is two (i.e., there is provided a pair of cylinders 12*b*). The cylinders 12*b* are made of metal and are respectively configured into a stepped cylindrical form. The cylinders 12*b* are loosely and coaxially inserted into the internal pressure variable chambers 121, respectively. Each cylinder 12*b* has a flange 12*bf* that projects radially outward. The flange 12*bf* of each cylinder 12*b* closely contacts an outer surface 12*as* of the casing 12*a*, so that the flange 12*bf* closes the corresponding internal pressure variable chamber 121 from an opposite side that is opposite from the cam receiving chamber 120. Each cylinder 12*b* forms a slide hole 122 and a valve installation hole 123. In each cylinder 12*b*, the slide hole 122 and the valve installation hole 123 are coaxially placed one after another in a continuous manner and are configured in a form of a cylindrical hole such that a central axis of the slide hole 122 and the valve installation hole 123 is substantially perpendicular to the central axis of the cam receiving chamber 120. The central axis of the slide hole 122 and the valve installation hole 123 of one of the cylinders 12*b* intersects the central axis of the slide hole 122 and the valve installation hole 123 of the other one of the cylinders 12*b* at substantially a right angle. In each cylinder 12*b*, the slide hole 122 extends from an end surface of the cylinder 12*b*, which is located on the cam receiving chamber 120 side, toward an opposite side. An opposite side portion of the slide hole 122, which is opposite from the cam receiving chamber 120, functions as a pressurizing chamber 122*a* (see FIG. 2). In each cylinder 12*b*, the valve installation hole 123 extends from the slide hole 122 toward an opposite end surface of the cylinder 12*b*, which is opposite from the cam receiving chamber 120.

The casing 12*a* and the cylinders 12*b*, which cooperate with each other to serve as the pump body 12, also cooperate with each other to form a suction passage 124, a plurality of release passages 125 and a plurality of discharge passages 126 shown in FIGS. 2 and 3. The suction passage 124 includes an inlet passage portion 124*a*, a common passage portion 124*b* and a plurality of branch passage portions 124*c*. The inlet passage portion 124*a* is formed in the casing 12*a* at a location that is spaced from the respective cylinders 12*b*. The inlet passage portion 124*a* extends from a suction pipe, which projects from the casing 12*a* toward an outside, to the outer peripheral portion of the cam receiving chamber 120. The inlet passage portion 124*a* is communicated with the low pressure filter 5 through a fuel passage 5*a* that is formed in an inside of a pipe joined to the suction pipe.

The common passage portion 124*b* is formed at a location that is between the cylinders 12*b* in the casing 12*a*. The common passage portion 124*b* extends from the outer peripheral portion of the cam receiving chamber 120 to a predetermined location in the casing 12*a*. In the present embodiment, the number of the branch passage portions 124*c* is two (i.e., there is provided a pair of branch passage portions 124*c*). Each branch passage portion 124*c* is branched from the common passage portion 124*b* to the pressurizing chamber 122*a* of the corresponding cylinder 12*b*. An upstream part 124*cu* of each branch passage portion 124*c* is formed at the location between the cylinders 12*b* in the casing 12*a*. The upstream part 124*cu* of each branch passage portion 124*c* extends between the corresponding internal pressure variable chamber 121 and the common passage portion 124*b*. A downstream part 124*cl* of each branch passage portion 124*c* extends from a corresponding location of the casing 12*a*, which is displaced away from the location between the cylinders 12*b*. The downstream part 124*cl* of each branch passage portion 124*c* extends between the corresponding internal pressure variable chamber 121 and the corresponding valve installation hole 123.

With the above-described extending structure, the suction passage 124 extends through the cam receiving chamber 120 and then the respective internal pressure variable chambers 121 at the location on the upstream side of the downstream parts 124*cl* of the respective branch passage portions 124*c*. Therefore, in the first embodiment, the fuel, which is pumped from the low pressure fuel pump 4, can be drawn into the inlet passage portion 124*a*, the cam receiving chamber 120, the common passage portion 124*b*, the upstream part 124*cu* of each branch passage portion 124*c*, each internal pressure variable chamber 121, and the downstream part 124*cl* of each branch passage portion 124*c* in this order.

In the present embodiment, the number of the release passages 125 is two (i.e., there is provided a pair of release passages 125). Each release passage 125 extends from the corresponding cylinder 12*b* to the location between the cylinders 12*b* in the casing 12*a*. Each release passage 125 extends between the corresponding valve installation hole 123 and the cam receiving chamber 120. A passage cross sectional area of each release passage 125 is set to be equal to or larger than a passage cross sectional area of the downstream part 124*cl* of the corresponding branch passage portion 124*c*. With the above-described construction, each release passage 125 is formed to implement the passage cross sectional area, which is equal to or larger than the passage cross sectional area of the downstream part 124*cl* of the corresponding branch passage portion 124*c* that is located on an opposite side of a control valve 11 (described later in detail), which is opposite from the release passage 125, while the control valve 11 is installed in the corresponding valve installation hole 123.

In the present embodiment, the number of the discharge passages 126 is two (i.e., there is provided a pair of discharge passages 126). Each discharge passage 126 is formed to extend from the corresponding cylinder 12*b* to a predetermined location of the casing 12*a*. Each discharge passage 126 extends from the pressurizing chamber 122*a* of the corresponding slide hole 122 to a discharge pipe that projects from the casing 12*a* to the outside of the casing 12*a*. Each discharge passage 126 is communicated with the pressure accumulation chamber of the common rail 6 through a fuel passage in a pipe joined to the discharge pipe.

A drain passage 127 and a relief passage 128, which are shown in FIG. 2, are formed at the casing 12*a* of the pump body 12. The drain passage 127 is formed at a corresponding location of the casing 12*a*, which is displaced away from the location between the cylinders 12*b*. The drain passage 127 extends from the outer peripheral portion of the cam receiving chamber 120 to a drain pipe that projects from the casing 12*a* to the outside of the casing 12*a*. Thereby, the two release passages 125, which respectively correspond to the two pressurizing chambers 122*a*, are independently connected to the common cam receiving chamber 120, so that the two release passages 125 are connected to the common drain passage 127 through the cam receiving chamber 120. A flow restricting portion 127*a*, which reduces the passage cross sectional area of the drain passage 127, is formed at the middle of the drain passage 127. Thus, in the cam receiving chamber 120, effective cooling of the drive cam 15 is made possible. The drain passage 127 is communicated with the inside of the fuel tank 3 through a fuel passage 3*a* formed in a pipe joined to the drain pipe. The relief passage 128 extends between an intermediate part of the inlet passage portion 124*a* and an intermediate part of the drain passage 127.

The pump filter 13 is placed at an upstream part of the inlet passage portion 124*a*, which is on an upstream side of a branch point where the relief passage 128 is branched from the inlet passage portion 124*a*. The pump filter 13 filters the fuel, which is pumped from the low pressure fuel pump 4, through the filter element of the pump filter 13. Therefore, the pump filter 13 captures foreign objects, which are mixed in the fuel at the time of feeding the fuel from the low pressure filter 5 to the pump filter 13.

The relief valve 14 is installed to the relief passage 128. The relief valve 14 is a pressure regulating valve that operates mechanically. The relief valve 14 opens when the pressure of the fuel, which is pumped by the low pressure fuel pump 4, is increased to an abnormal value, which is deviated from a normal value (a normal range), at the pump operation time to discharge the pumped fuel to the passages 128, 127, 3*a* and the fuel tank 3, thereby reducing the pressure of the discharged fuel.

As shown in FIGS. 2 and 3, the drive cam 15 is coaxially received in the cam receiving chamber 120. The drive cam 15 is rotated about a central axis of the cam receiving chamber 120 and of the drive cam 15 when the drive cam 15 receives the crank torque from the crankshaft 1*a* (see FIG. 1) of the internal combustion engine 1. In view of, for example, the number of the cylinders of the internal combustion engine 1 and a speed reducing ratio of the crankshaft 1*a*, the drive cam 15 is shaped in a form of a plate cam that has an curved profile line of an oval type at an outer peripheral surface 15*a* of the drive cam 15.

In the present embodiment, the number of the movable units 16 is two (i.e., there is provided a pair of movable units 16). Each movable unit 16 includes a roller 160, a tappet 161, a plunger 162, a spring seat 163 and a compression coil spring 164. Each of these constituent components of the movable unit 16 is made of metal. The plunger 162 of each movable unit 16 is received in and extends in the corresponding internal pressure variable chamber 121 and the slide hole 122. The remaining constituent components of each movable unit 16, which are other than the plunger 162, are received in the corresponding internal pressure variable chamber 121.

The roller 160 of each movable unit 16 is shaped into a cylindrical form that is substantially parallel to the central axis of the drive cam 15 and is substantially perpendicular to the central axis of the corresponding internal pressure variable chamber 121. The roller 160 of each movable unit 16 is in rolling contact with the outer peripheral surface 15*a* of the drive cam 15 in a state where the roller 160 makes line contact with the outer peripheral surface 15*a* of the drive cam 15 along the central axis of the drive cam 15.

The tappet 161 of each movable unit 16 includes two members 161*a*, 161*b* that cooperate with each other and are assembled together in a form of a bottomed cylindrical tubular body that extends substantially perpendicular to the central axis of the drive cam 15 and is coaxial with the corresponding internal pressure variable chamber 121. The tappet 161 of each movable unit 16 is placed such that an opening of the tappet 161 is directed toward the corresponding slide hole 122. The tappet 161 of each movable unit 16 is fitted to and is slidably supported by an inner peripheral surface of the corresponding internal pressure variable chamber 121, so that the tappet 161 can reciprocate in the axial direction. The tappet 161 of each movable unit 16 holds the corresponding roller 160 such that the roller 160 can rotate relative to the tappet 161 and can reciprocate integrally with the tappet 161.

The plunger 162 of each movable unit 16 is shaped into a cylindrical rod form that is substantially perpendicular to the central axis of the drive cam 15 and is coaxial with the internal pressure variable chamber 121. The plunger 162 of each movable unit 16 is fitted to and is slidably supported by an inner peripheral surface of the corresponding slide hole 122, so that the plunger 162 can reciprocate in the axial direction. The plunger 162 of each movable unit 16 is inserted into an inside of a peripheral wall portion (i.e., the tubular member 161*a*) of the tappet 161 and contacts a bottom wall portion (i.e., the plate member 161*b*) of the tappet 161. The plunger 162 of each movable unit 16 defines the pressurizing chamber 122*a* in the corresponding slide hole 122 at an opposite side that is opposite from the tappet 161.

The spring seat 163 of each movable unit 16 is held by the corresponding plunger 162 such that the plunger 162 can reciprocate integrally with the spring seat 163. The compression coil spring 164 of each movable unit 16 is clamped between the corresponding cylinder 12*b* and the spring seat 163 of the movable unit 16. The compression coil spring 164, which is held at the clamping point of the movable unit 16 and is placed in a resiliently deformed state, urges the plunger 162 against the bottom wall portion (i.e., the plate member 161*b*) of the tappet 161 and urges the roller 160 against the outer peripheral surface 15*a* of the drive cam 15.

With this urging structure, the plunger 162 of each movable unit 16, which is in a suction stroke, is driven toward a suction side for suctioning the fuel into the corresponding pressurizing chamber 122*a* in response to the rotation of the drive cam 15, so that the plunger 162 is moved downward between the top dead center and the bottom dead center. The tappet 161 of each movable unit 16, which is driven in response to progress of the suction stroke, increases the inflow volume of the fuel into the corresponding internal pressure variable chamber 121, so that the internal pressure of the internal pressure variable chamber 121 is reduced.

In contrast, the plunger 162 of each movable unit 16 in a delivery stroke is driven toward a delivery side for delivering the fuel out of the corresponding pressurizing chamber 122*a* upon pressurization of the fuel in response to the rotation of the drive cam 15, so that the plunger 162 is moved upward between the bottom dead center and the top dead center. The tappet 161 of each movable unit 16, which is driven in response to the progress of this delivery stroke, reduces the inflow volume of the fuel into the corresponding internal pressure variable chamber 121, so that the internal pressure of the corresponding internal pressure variable chamber 121 is increased.

In the present embodiment, as shown in FIG. 2, the number of the discharge valves 17 is two (i.e., there is provided a pair of discharge valves 17). Each discharge valve 17 is a check valve that is mechanically operated. Each discharge valve 17 is placed in the corresponding discharge passage 126. Each discharge valve 17 opens and discharges the fuel into the discharge passage 126 to deliver the discharged fuel to the common rail 6 when the pressure of the fuel in the corresponding pressurizing chamber 122*a* becomes a normal value that is normal in the delivery stroke.

In the present embodiment, as shown in FIGS. 2 and 3, the number of the control valves 11 is two (i.e., there is provided a pair of control valves 11). Each control valve 11 is fitted in the corresponding valve installation hole 123 and is thereby placed between the corresponding branch passage portion 124*c* of the suction passage 124 and the corresponding pressurizing chamber 122*a*. With this installation structure, each release passage 125 is communicated with the downstream part 124*cl* of the corresponding branch passage portion 124*c* of the suction passage 124 through the corresponding control valve 11. Specifically, a communicating connection of the suction passage 124 relative to each corresponding release passage 125 is the downstream part 124*cl* of the corresponding branch passage portion 124*c*.

Figure 4A:
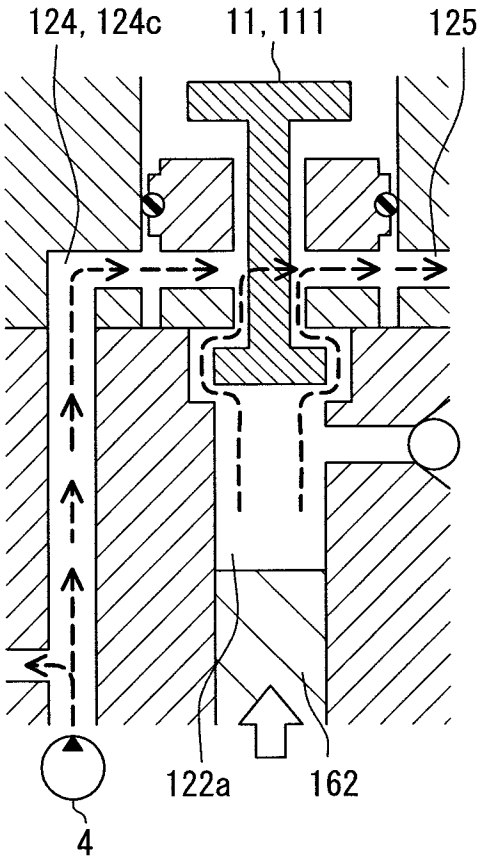
FIGS. 4A to 4C are cross-sectional views for describing an operation of the high pressure fuel pump of the first embodiment.
Figure 4B:
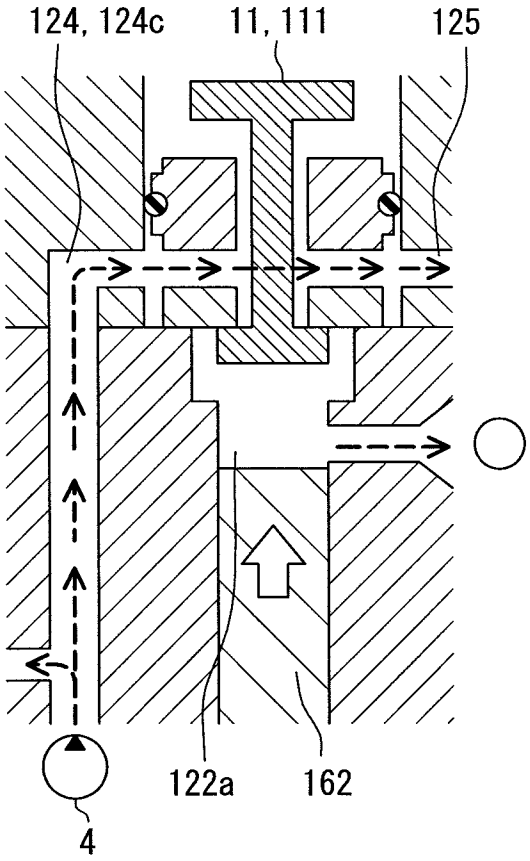
Figure 4C:
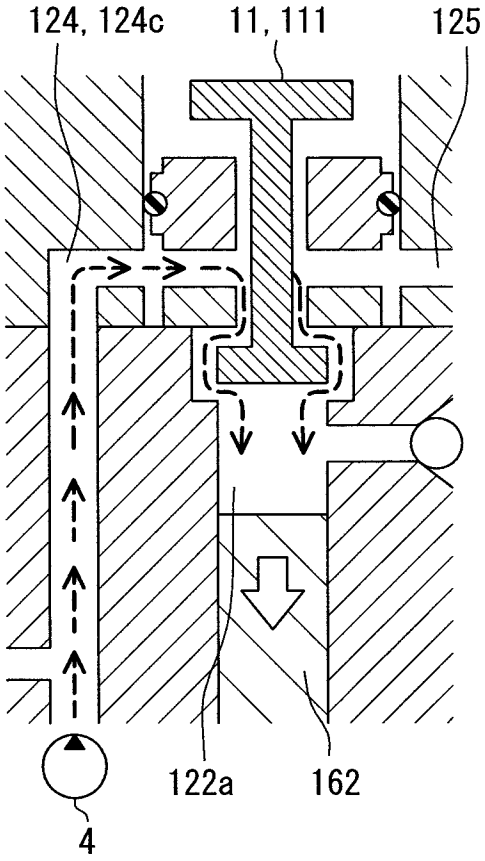

In the present embodiment, as shown in FIG. 3, each control valve 11 is an electromagnetic valve of a normally open type that is driven by supplying the electric power to the electromagnetic valve. Each control valve 11 includes a solenoid coil 110 and a valve member 111 made of metal. As shown in FIGS. 4A and 4C, each control valve 11 is opened when the valve member 111 is displaced away from a valve seat through turning off of an electric current pulse from the ECU 8 to the solenoid coil 110 (i.e., by stopping the supply of the electric power to the solenoid coil 110), so that the connection between the corresponding branch passage portion 124*c* and the corresponding pressurizing chamber 122*a* is opened. In contrast, as shown in FIG. 4B, each control valve 11 is closed when the valve member 111 is seated against the valve seat through turning on of the electric current pulse from the ECU 8 to the solenoid coil 110 (i.e., by the supply of the electric power to the solenoid coil 110), so that the connection between the corresponding branch passage portion 124*c* and the corresponding pressurizing chamber 122*a* is closed (i.e., is blocked).

The operation of the high pressure fuel pump 10 having the above-described structure will now be described. The high pressure fuel pump 10 is operated when the ECU 8 starts an electric power supply control operation of the high pressure fuel pump 10 together with an electric power supply control operation of the low pressure fuel pump 4 and an electric power supply control operation of the respective control valves 11 in response to starting of the internal combustion engine 1 upon turning on of a power switch at the vehicle.

In the high pressure fuel pump 10, the delivery stroke of one of the pressurizing chambers 122*a* and the delivery stroke of the other one of the pressurizing chambers 122*a* are alternately and continuously executed one after another and are thereby completely shifted, i.e., deviated from each other with respect to the execution timing thereof. However, the operation at each of these pressurizing chambers 122*a* is substantially identical. Therefore, the operation of only one of the pressurizing chambers 122*a* will be representatively described.

Figure 5:
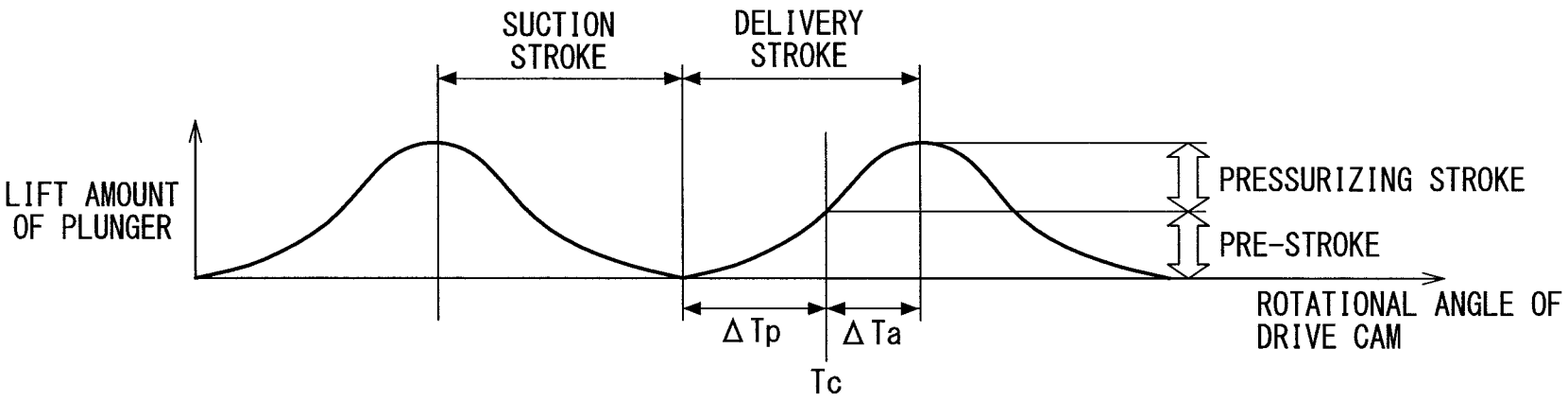
FIG. 5 is a graph for describing the operation of the high pressure fuel pump of the first embodiment.

With reference to FIG. 5, which indicates a relationship between a lift amount of the plunger 162 and the rotational angle of the drive cam 15, when the operation of the one of the pressurizing chambers 122*a* is seen alone, the suction stroke and the delivery stroke are alternately and continuously executed. Here, a time period, which is before closing timing (i.e., a closing time point) Tc for closing the connection between the branch passage portion 124*c* of the suction passage 124 and the one of the pressurizing chambers 122*a* by the control valve 11 during the delivery stroke, is defined as a pre-stroke period $\Delta Tp$, in which the plunger 162 makes a pre-stroke. Furthermore, a time period, which is after the closing timing Tc during the delivery stroke, is defined as a pressurizing period $\Delta Ta$, in which the plunger 162 makes a pressurizing stroke for pressurizing the fuel. In the following description with respect to the operation of the first embodiment, the one of the pressurizing chambers 122*a* will be simply referred to as the pressurizing chamber 122*a*.

First of all, at the suction stroke shown in FIG. 4C, the control valve 11 opens the connection between the branch passage portion 124*c* and the pressurizing chamber 122*a*. Thereby, in the suction stroke, the plunger 162 is driven downward, so that the fuel, which is pumped from the low pressure fuel pump 4, is suctioned into the pressurizing chamber 122*a* through the suction passage 124.

Next, in the pre-stroke period ΔTp of the delivery stroke shown in FIG. 4A, the control valve 11 maintains the open state of the connection between the suction passage 124 and the pressurizing chamber 122*a*, which is placed into the open state in the previous suction stroke. At this time, in the present embodiment, an opening degree (i.e., a valve opening degree) of the control valve 11 is adjusted to substantially the same degree as that of the suction stroke. Thereby, in the pre-stroke period ΔTp, the plunger 162 is driven upward to pressurize the fuel in the pressurizing chamber 122*a*. At this time, as indicated by a broken line arrow in FIG. 4A, the fuel, which is pressurized by the plunger 162, tends to flow backward from the pressurizing chamber 122*a* into the branch passage portion 124*c* through the control valve 11. However, this fuel is relieved to the release passage 125, which is communicated with the branch passage portion 124*c* through the control valve 11. Thereby, at the branch passage portion 124*c* and the upstream side thereof in the suction passage 124, a backflow generation alleviating effect is implemented such that the generation of the backflow against the fuel flow from the low pressure fuel pump 4 is alleviated. Furthermore, at this time, at the suction passage 124 that passes through the internal pressure variable chamber 121 (see FIGS. 2 and 3), in which the internal pressure is increased in response to the progress of the delivery stroke, even when the return fuel flow is generated from the pressurizing chamber 122*a*, the increased internal pressure of the internal pressure variable chamber 121 exerts a flow resistance against the return fuel flow, so that the backflow generation alleviating effect is enhanced.

Next, in the pressurizing period ΔTa in the delivery stroke shown in FIG. 4B, the control valve 11 closes the connection between the branch passage portion 124*c* and the pressurizing chamber 122*a*. Therefore, in the pressurizing period ΔTa, the return of the fuel from the pressurizing chamber 122*a* to the branch passage portion 124*c* is stopped or limited. Thereby, at the branch passage portion 124*c* and the upstream side thereof in the suction passage 124, the backflow generation alleviating effect for the fuel flow from the low pressure fuel pump 4 is implemented continuously since the time of the pre-stroke period ΔTp. At this time, the fuel, which is pumped from the low pressure fuel pump 4, is directly relieved into the release passage 125.

Thus, at the subsequent suction stroke, as shown in FIG. 4C, the branch passage portion 124*c* and the upstream side thereof in the suction passage 124 is in a forward flow generating state where the flow of the fuel from the low pressure fuel pump 4 toward the pressurizing chamber 122*a* is eased. Here, as discussed above, at the suction stroke, during which the control valve 11 opens the connection between the branch passage portion 124*c* and the pressurizing chamber 122*a*, the fuel pressure for filling the pressurizing chamber 122*a* with the fuel, which is in the forward flow generating state, can be minimized at the low pressure fuel pump 4. Therefore, the drive electric power for driving the low pressure fuel pump 4 and the energy for suctioning the fuel into the pressurizing chamber 122*a* through the suction passage 124 can be minimized or reduced.

Effects and Advantages

Now, effects and advantages of the first embodiment will be described.

The fuel, which is pressurized by the plunger 162, tends to return from the pressurizing chamber 122*a* into the suction passage 124, at the time before the closing timing Tc during the delivery stroke according to the first embodiment. However, this fuel is relieved to the release passage 125, which is communicated with the suction passage 124, so that the generation of the backflow of the fuel can be alleviated at the suction passage 124. Therefore, the returning of the fuel is limited at the connection between the pressurizing chamber 122*a* and the suction passage 124, which is closed by the control valve 11, after the closing timing Tc in the delivery stroke of the first embodiment, so that the generation of the backflow of the fuel at the suction passage 124 can be alleviated continuously since the time before the closing timing Tc. In this way, the suction passage 124, in which the generation of the backflow can be alleviated at the time of starting the suction stroke of the first embodiment, is in the forward flow generating state where the flow of the fuel from the low pressure fuel pump 4 toward the pressurizing chamber 122*a* is eased. In this forward flow generating state, the fuel pressure for filling the fuel into the pressurizing chamber 122*a* through the suctioning of the fuel at the suction stroke with the limited time period, and the energy for suctioning the fuel into the pressurizing chamber 122*a* through the suction passage 124 can be minimized at the low pressure fuel pump 4. Thereby, the energy loss can be limited.

Furthermore, according to the first embodiment, in the suction passage 124 that passes through the internal pressure variable chamber 121, in which the internal pressure is increased in response to the progress of the delivery stroke, at the location on the upstream side of the communicating connection of the suction passage 124 relative to the release passage 125, the increased internal pressure of the internal pressure variable chamber 121 can exert the flow resistance against the return fuel flow from the pressurizing chamber 122*a*. Thereby, in addition to the relieving function for relieving the return fuel flow at the release passage 125, the backflow generation alleviating effect can be enhanced. Thus, the reliability with respect to the advantage of limiting the energy loss can be improved.

Second Embodiment

Figure 6:
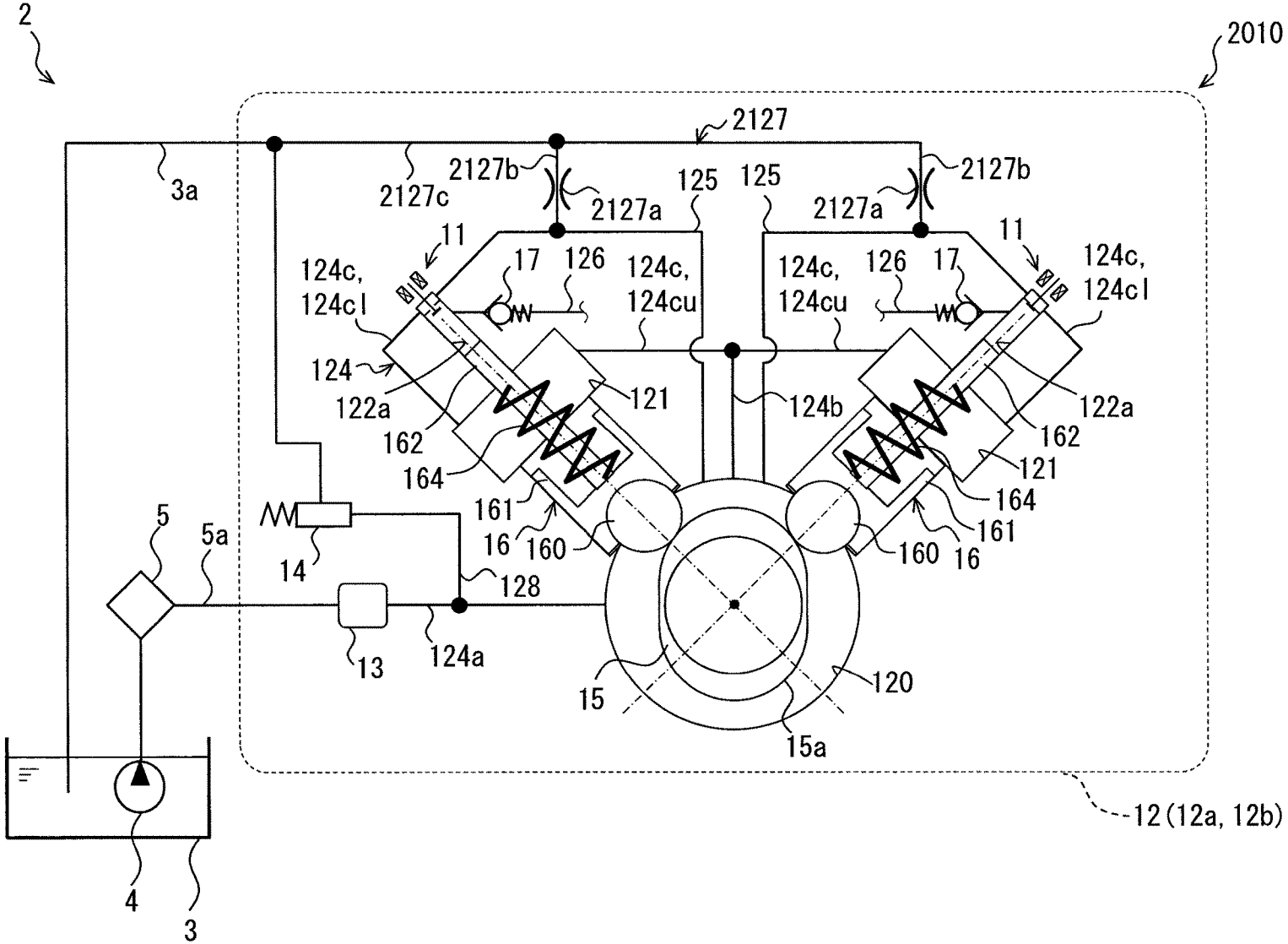
FIG. 6 is a structural diagram indicating a high pressure fuel pump according to a second embodiment.

As shown in FIG. 6, a second embodiment of the present disclosure is a modification of the first embodiment. The drain passage 2127 of the high pressure fuel pump 2010 of the second embodiment includes a plurality of individual passage portions 2127*b* and a merging passage portion 2127*c*. The individual passage portions 2127*b* and the merging passage portion 2127*c* are respectively formed at a predetermined location of the casing 12*a*.

In the present embodiment, the number of the individual passage portions 2127*b* is two (i.e., there is provided a pair of individual passage portions 2127*b*). Each individual passage portion 2127*b* extends from the corresponding release passage 125 to the merging passage portion 2127*c* that is common to the individual passage portions 2127*b*. In other words, each release passage 125 is directly connected to the corresponding individual passage portion 2127*b* in the drain passage 2127. A flow restricting portion 2127*a* is formed at an intermediate part of each individual passage portion 2127*b* such that a passage cross-sectional area of the flow restricting portion 2127*a* is reduced in comparison to a passage cross-sectional area of the corresponding release passage 125. Specifically, in the present embodiment, the number of the flow restricting portions 2127*a* is two (i.e., there is provided a pair of flow restricting portions 2127*a*). The merging passage portion 2127*c* extends from a downstream end of each of the individual passage portions 2127*b* to the drain pipe that projects from the casing 12*a* to the outside of the casing 12*a*.

As discussed above, according to the second embodiment, the passage cross-sectional area of at least the corresponding portion of the drain passage 2127, which is directly connected to the corresponding release passage 125, is reduced in comparison to the passage cross-sectional area of the corresponding release passage 125. Specifically, the passage cross-sectional area of at least the corresponding portion of the drain passage 2127, to which the fuel can be drained from the corresponding release passage 125, is reduced in comparison to the passage cross-sectional area of the release passage 125. Accordingly, air, which is accumulated in the suction passage 124 and the pressurizing chambers 122*a* during the stop period (non-operating period) of the low pressure fuel pump 4, is pressurized upon restarting of the operation of the low pressure fuel pump 4 and can be discharged into the release passages 125 and the drain passage 2127 in this order. Thus, it is possible to limit a deterioration in a fuel filling performance for filling the fuel into the pressurizing chambers 122*a*, which would be otherwise caused by interfering of the suctioning of the fuel into the suction passage 124 and the pressurizing chambers 122*a* by the accumulated air. Therefore, it is possible to limit the energy loss and the deterioration in the delivery performance of the fuel from each pressurizing chamber 122*a*.

Third Embodiment

Figure 7:
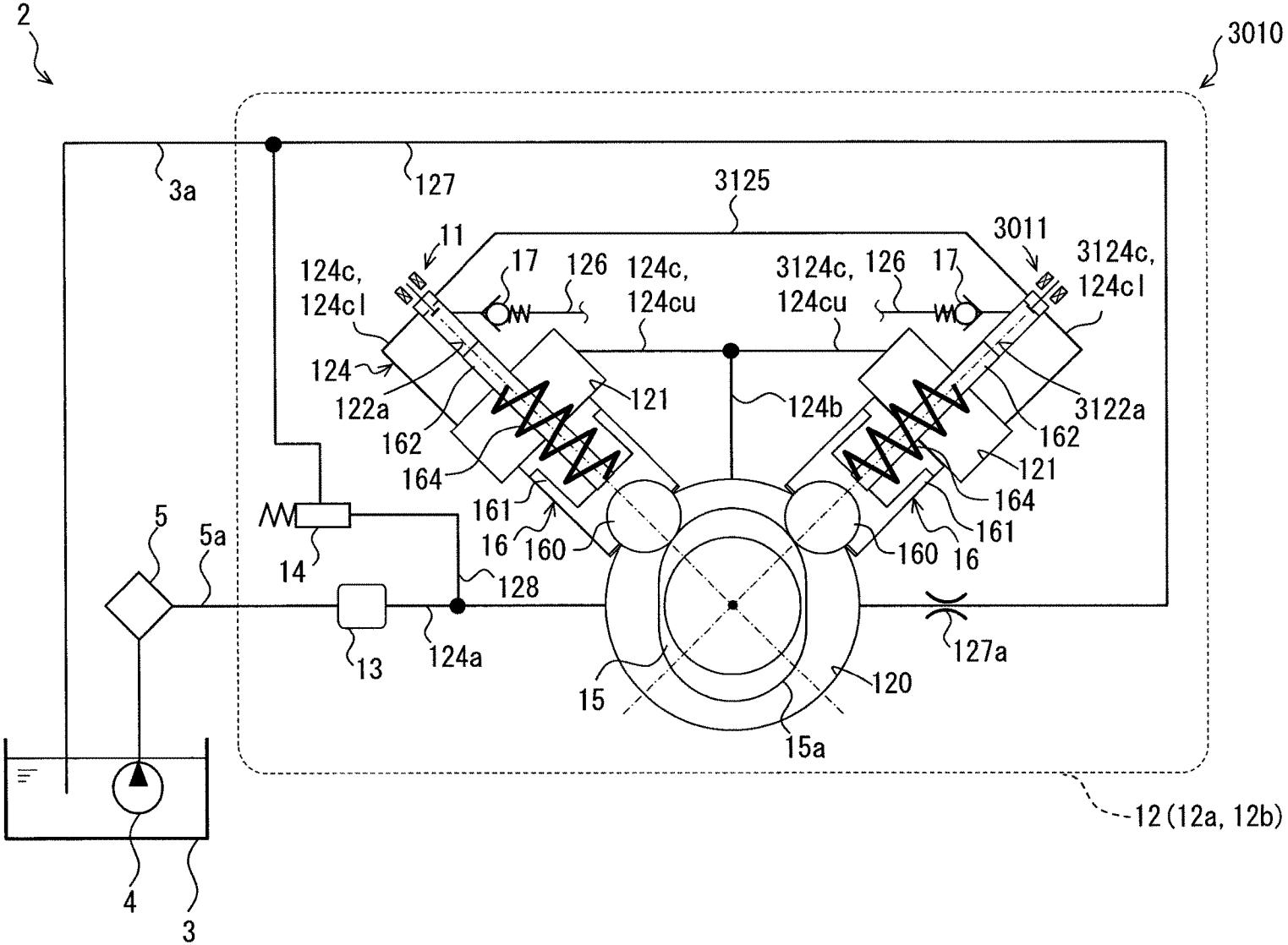
FIG. 7 is a structural diagram indicating a high pressure fuel pump according to a third embodiment.
Figure 8:
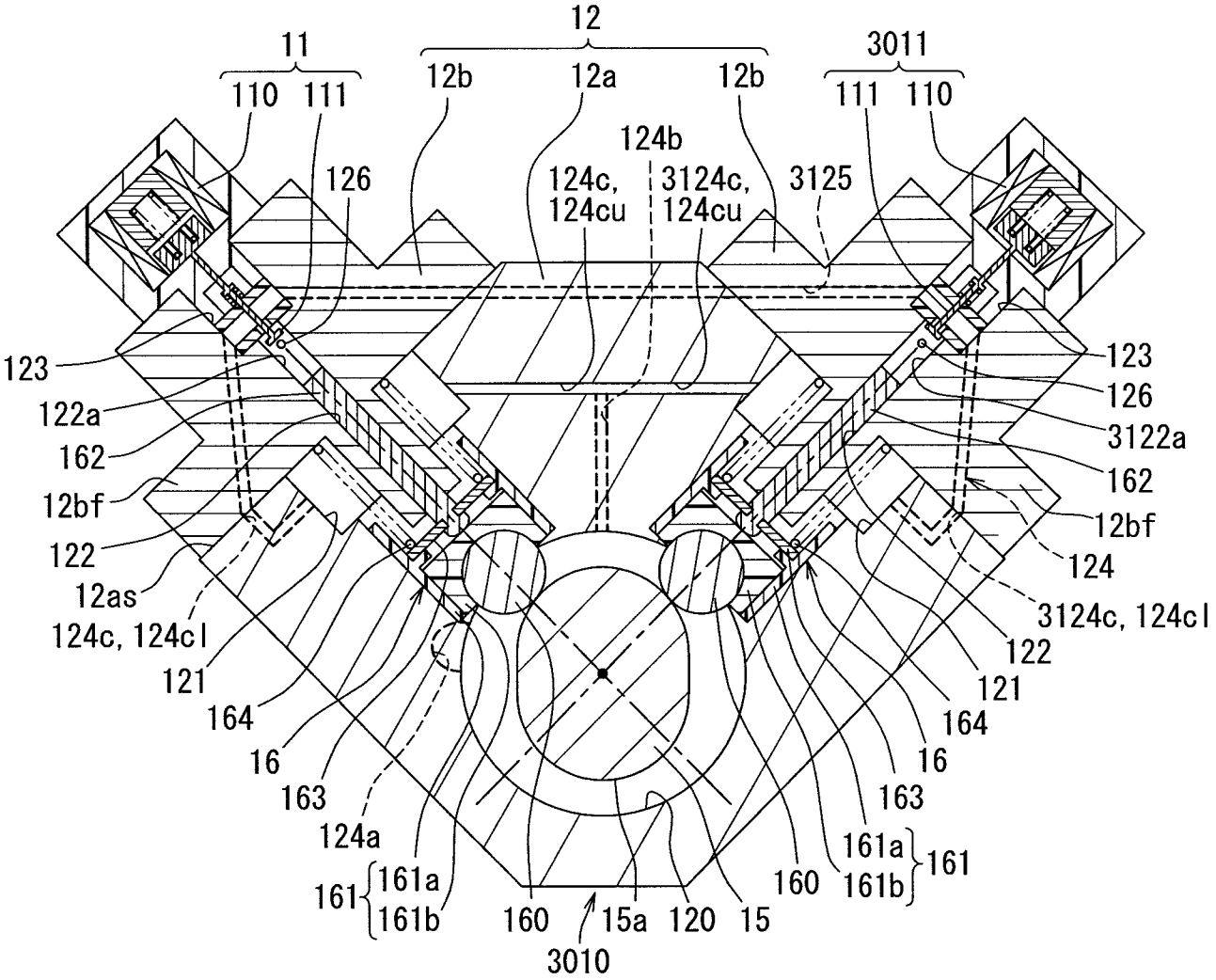
FIG. 8 is a cross-sectional view indicating the high pressure fuel pump according to the third embodiment.

As shown in FIGS. 7 and 8, a third embodiment of the present disclosure is a modification of the first embodiment. The two pressurizing chambers 122*a* of the first embodiment are respectively defined as a first pressurizing chamber 122*a* and a second pressurizing chamber 3122*a* in a high pressure fuel pump 3010 according to the third embodiment while the delivery stroke of the primary pressurizing chamber 122*a* and the delivery stroke of the secondary pressurizing chamber 3122*a* are alternately and continuously executed and are thereby shifted, i.e., deviated from each other. Furthermore, the two branch passage portions 124*c* of the suction passage 124 of the first embodiment are respectively defined as a first primary branch passage portion 124*c*, which is branched toward the primary pressurizing chamber 122*a*, and a secondary branch passage portion 3124*c*, which is branched toward the secondary pressurizing chamber 3122*a*, in the third embodiment. Additionally, the two control valves 11 of the first embodiment are respectively defined as a primary control valve 11, which opens and closes a connection between the primary pressurizing chamber 122*a* and the primary branch passage portion 124*c*, and a secondary control valve 3011, which opens and closes a connection between the secondary pressurizing chamber 3122*a* and the secondary branch passage portion 3124*c*, in the third embodiment.

The release passage 3125 of the third embodiment under the above definitions extends between the two valve installation holes 123 as if the two release passages 125 of the first embodiment are joined together. In this way, the release passage 3125 is communicated with the downstream part 124*cl* of the primary branch passage portion 124*c* through the primary control valve 11 and is also communicated with the downstream part 124*cl* of the secondary branch passage portion 3124*c* through the secondary control valve 3011. The release passage 3125 extends from the corresponding cylinder 12*b* to the location between the cylinders 12*b* in the casing 12*a*. Furthermore, on the upstream side of the corresponding downstream part 124*cl*, which forms the communicating connection relative to the release passage 3125, at each branch passage portion 124*c*, 3124*c*, the suction passage 124 passes through the common cam receiving chamber 120 and then passes through each internal pressure variable chamber 121.

According to the third embodiment, the fuel of the primary pressurizing chamber 122*a*, which is pressurized by the plunger 162 before the closing timing Tc during the delivery stroke at the primary pressurizing chamber 122*a*, tends to return to the primary branch passage portion 124*c* that is branched toward the primary pressurizing chamber 122*a* in the suction passage 124. At this time, when the suction stroke is executed in the secondary pressurizing chamber 3122*a*, in which the timing of executing the delivery stroke is shifted from the timing of executing the delivery stroke in the primary pressurizing chamber 122*a*, the secondary branch passage portion 3124*c*, which is branched toward the secondary pressurizing chamber 3122*a*, receives a suction pressure from the secondary pressurizing chamber 3122*a* through the communicating connection between the secondary branch passage portion 3124*c* and the secondary pressurizing chamber 3122*a* that is opened. Particularly, in the secondary pressurizing chamber 3122*a*, which is designed such that the secondary pressurizing chamber 3122*a* and the primary pressurizing chamber 122*a* execute the delivery stroke in turn, the suction stroke must be executed, so that the secondary branch passage portion 3124*c* is likely to receive the suction pressure for a relatively long period of time.

Therefore, in the third embodiment, the suction pressure is conducted from the secondary branch passage portion 3124*c* to the primary branch passage portion 124*c* through the release passage 3125 that is communicated with the primary and secondary branch passage portions 124*c*, 3124*c*. In this way, the fuel, which tends to return from the primary pressurizing chamber 122*a* to the primary branch passage portion 124*c*, is drawn by the conducted suction pressure and is thereby likely relieved into the release passage 3125, so that the backflow generation alleviating effect in the suction passage 124 can be enhanced.

This enhanced backflow generation alleviating effect can be similarly implemented before the closing timing Tc during the delivery stroke at the secondary pressurizing chamber 3122*a* because of a similar principle, which is substantially the same as the principle discussed above with reference to the primary pressurizing chamber 122*a* except that the secondary pressurizing chamber 3122*a* is used in place of the primary pressurizing chamber 122*a*.

Specifically, in the third embodiment, the fuel of the secondary pressurizing chamber 3122*a*, which is pressurized by the plunger 162 before the closing timing Tc during the delivery stroke at the secondary pressurizing chamber 3122*a*, tends to return to the secondary branch passage portion 3124*c*, which is branched toward the secondary pressurizing chamber 3122*a* in the suction passage 124. At this time, when the suction stroke is executed in the primary pressurizing chamber 122*a*, in which the timing of executing the delivery stroke is shifted from the timing of executing the delivery stroke in the secondary pressurizing chamber 3122*a*, the primary branch passage portion 124*c*, which is branched toward the primary pressurizing chamber 122*a*, receives a suction pressure from the primary pressurizing chamber 122*a* through the communicating connection between the primary branch passage portion 124*c* and the primary pressurizing chamber 122*a* that is opened. Particularly, in the primary pressurizing chamber 122*a*, which is designed such that the primary pressurizing chamber 122*a* and the secondary pressurizing chamber 3122*a* execute the delivery stroke in turn, the suction stroke must be executed, so that the primary branch passage portion 124*c* is likely to receive the suction pressure for a relatively long period of time.

Therefore, the suction pressure is conducted from the primary branch passage portion 124*c* to the secondary branch passage portion 3124*c* through the release passage 3125 that is communicated with the primary and secondary branch passage portions 124*c*, 3124*c*. In this way, the fuel, which tends to return from the secondary pressurizing chamber 3122*a* to the secondary branch passage portion 3124*c*, is drawn by the conducted suction pressure and is thereby likely relieved into the release passage 3125, so that the backflow generation alleviating effect in the suction passage 124 can be enhanced.

Therefore, according to the third embodiment, the reliability with respect to the advantage of limiting the energy loss can be improved.

Fourth Embodiment

Figure 9:
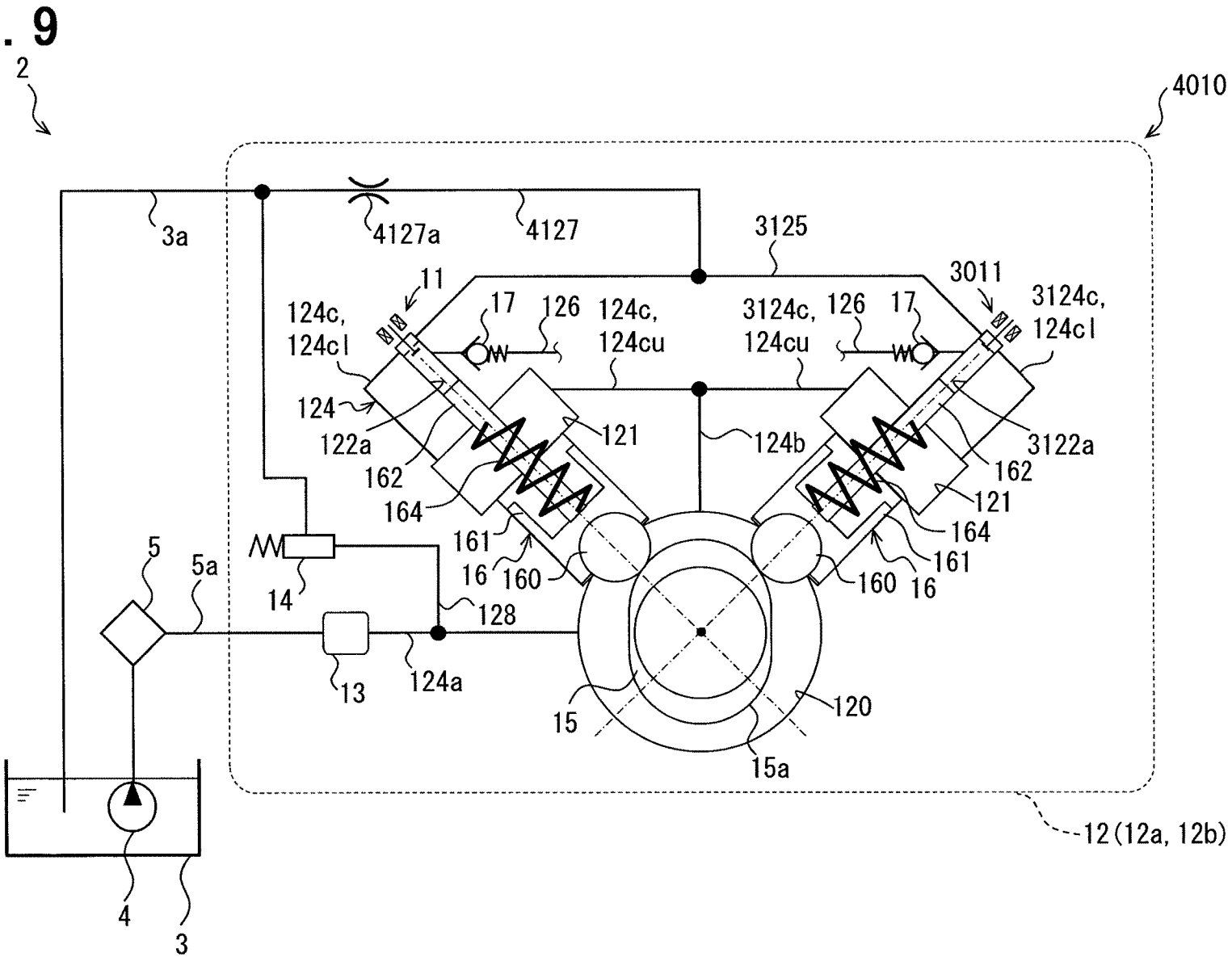
FIG. 9 is a structural diagram indicating a high pressure fuel pump according to a fourth embodiment.
Figure 10:
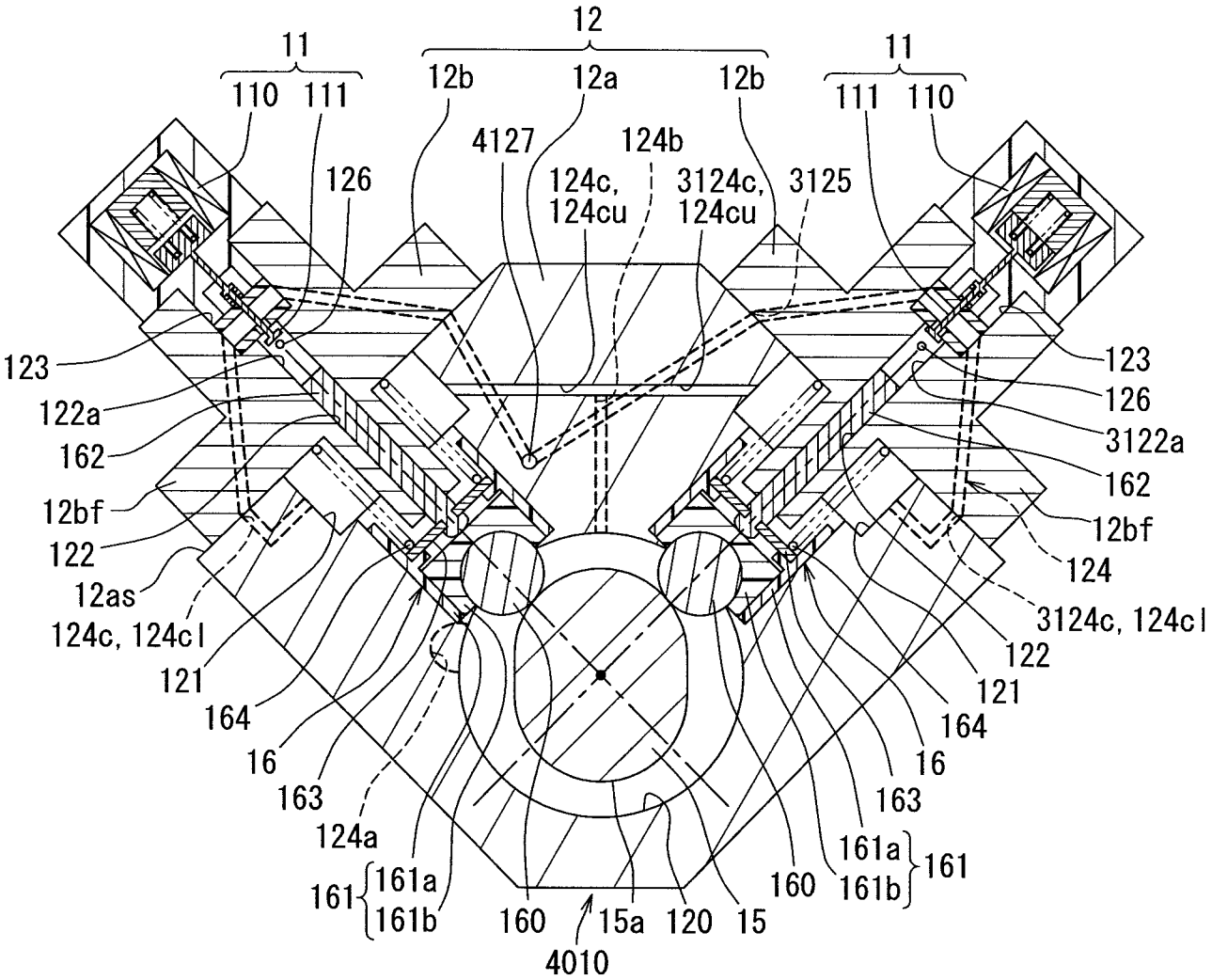
FIG. 10 is a cross-sectional view indicating the high pressure fuel pump according to the fourth embodiment.

As shown in FIGS. 9 and 10, a fourth embodiment of the present disclosure is a modification of the third embodiment. The drain passage 4127 of the high pressure fuel pump 4010 of the fourth embodiment extends from an intermediate part of the release passage 3125 to the drain pipe that projects from the casing 12*a* to the outside of the casing 12*a*. In other words, the release passage 3125 is directly connected to the drain passage 4127. A flow restricting portion 4127*a* is formed at the intermediate part of the drain passage 4127 such that a passage cross-sectional area of the flow restricting portion 4127*a* is reduced in comparison to a passage cross-sectional area of the release passage 3125. The drain passage 4127 is formed at the location that is between the cylinders 12*b* in the casing 12*a*.

As discussed above, according to the fourth embodiment, the passage cross-sectional area of at least the portion of the drain passage 4127, which is directly connected to the release passage 3125, is reduced in comparison to the passage cross-sectional area of the release passage 3125. Specifically, the passage cross-sectional area of at least the corresponding portion of the drain passage 2127, to which the fuel can be directly drained from the release passage 3125, is reduced in comparison to the passage cross-sectional area of the release passage 3125. Accordingly, the air, which is accumulated in the suction passage 124 and the pressurizing chambers 122*a*, 3122*a* during the stop period (the non-operating period) of the low pressure fuel pump 4, is pressurized upon restarting of the operation of the low pressure fuel pump 4 and can be discharged into the release passage 3125 and the drain passage 4127 in this order. Thus, it is possible to limit the deterioration in the fuel filling performance for filling the fuel into the pressurizing chambers 122*a*, 3122*a*, which would be otherwise caused by interfering of the suctioning of the fuel into the suction passage 124 and the pressurizing chambers 122*a*, 3122*a* by the accumulated air. Therefore, it is possible to limit the energy loss and the deterioration in the delivery performance of the fuel from each pressurizing chamber 122*a*, 3122*a*.

Fifth Embodiment

Figure 11:
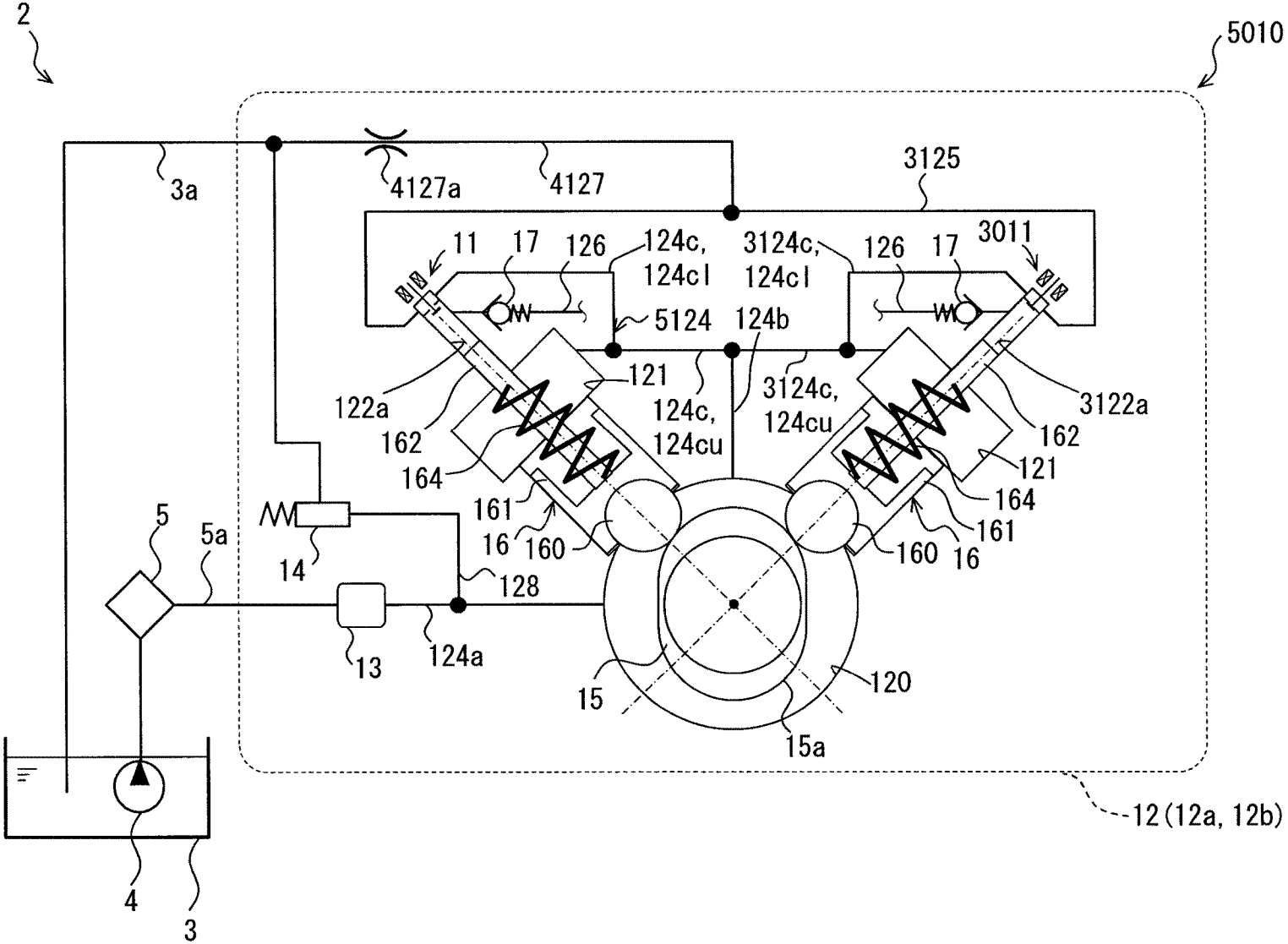
FIG. 11 is a structural diagram indicating a high pressure fuel pump according to a fifth embodiment.

As shown in FIG. 11, a fifth embodiment of the present disclosure is a modification of the fourth embodiment. In the suction passage 5124 of the high pressure fuel pump 5010 of the fifth embodiment, the downstream part 124*cl* of each of the primary and secondary branch passage portions 124*c*, 3124*c* extends between an intermediate part of the upstream part 124*c*u of the branch passage portion 124*c*, 3124*c* and the corresponding valve installation hole 123. In this way, the release passage 3125 is communicated with the downstream part 124*cl* of the primary branch passage portion 124*c* through the primary control valve 11 and is also communicated with the downstream part 124*cl* of the secondary branch passage portion 3124*c* through the secondary control valve 3011. The upstream part 124*c*u and the downstream part 124*cl* of each branch passage portion 124*c*, 3124*c* extend from the location between the cylinders 12*b* in the casing 12*a*.

Therefore, in the fifth embodiment, the fuel, which is pumped from the low pressure fuel pump 4, can be suctioned through the inlet passage portion 124*a*, the cam receiving chamber 120, the common passage portion 124*b*, the upstream part 124*c*u of each branch passage portion 124*c*, 3124*c*, and the downstream part 124*cl* of each branch passage portion 124*c*, 3124*c* in this order. Furthermore, in the fifth embodiment, the fuel, which is pumped from the low pressure fuel pump 4, can be fed to the cam receiving chamber 120, the common passage portion 124*b*, the upstream part 124*cu* of each branch passage portion 124*c*, 3124*c*, and each internal pressure variable chamber 121 in this order. Thereby, the suction passage 5124 of the fifth embodiment supplies the fuel to each pressurizing chamber 122*a*, 3122*a* while the suction passage 5124 bypasses each internal pressure variable chamber 121 at the location on the upstream side of the corresponding downstream part 124*cl*, which forms the communicating connection relative to the release passage 3125, in each branch passage portion 124*c*, 3124*c*.

According to the fifth embodiment discussed above, in the suction passage 5124 that bypasses each internal pressure variable chamber 121, in which the internal pressure is increased and decreased upon the driving of the movable unit 16 including the plunger 162, at the location on the upstream side of the communicating connection of the suction passage 5124 relative to the release passage 3125, it is less likely that foreign objects, which are generated through the driving of the movable unit 16, are mixed into the fuel. Thus, it is possible to limit the deterioration in the backflow generation alleviating effect that would be caused by clogging of the release passage 3125 with the foreign objects mixed into the fuel in the suction passage 5124. As a result, the energy loss can be limited for a relatively long period of time.

Furthermore, according to the fifth embodiment, the branch passage portions 124*c*, 3124*c* of the suction passage 5124 can be collectively formed between the cylinders 12*b* in the pump body 12, so that this arrangement can contribute to the size reduction of the pump body 12.

Sixth Embodiment

Figure 12:
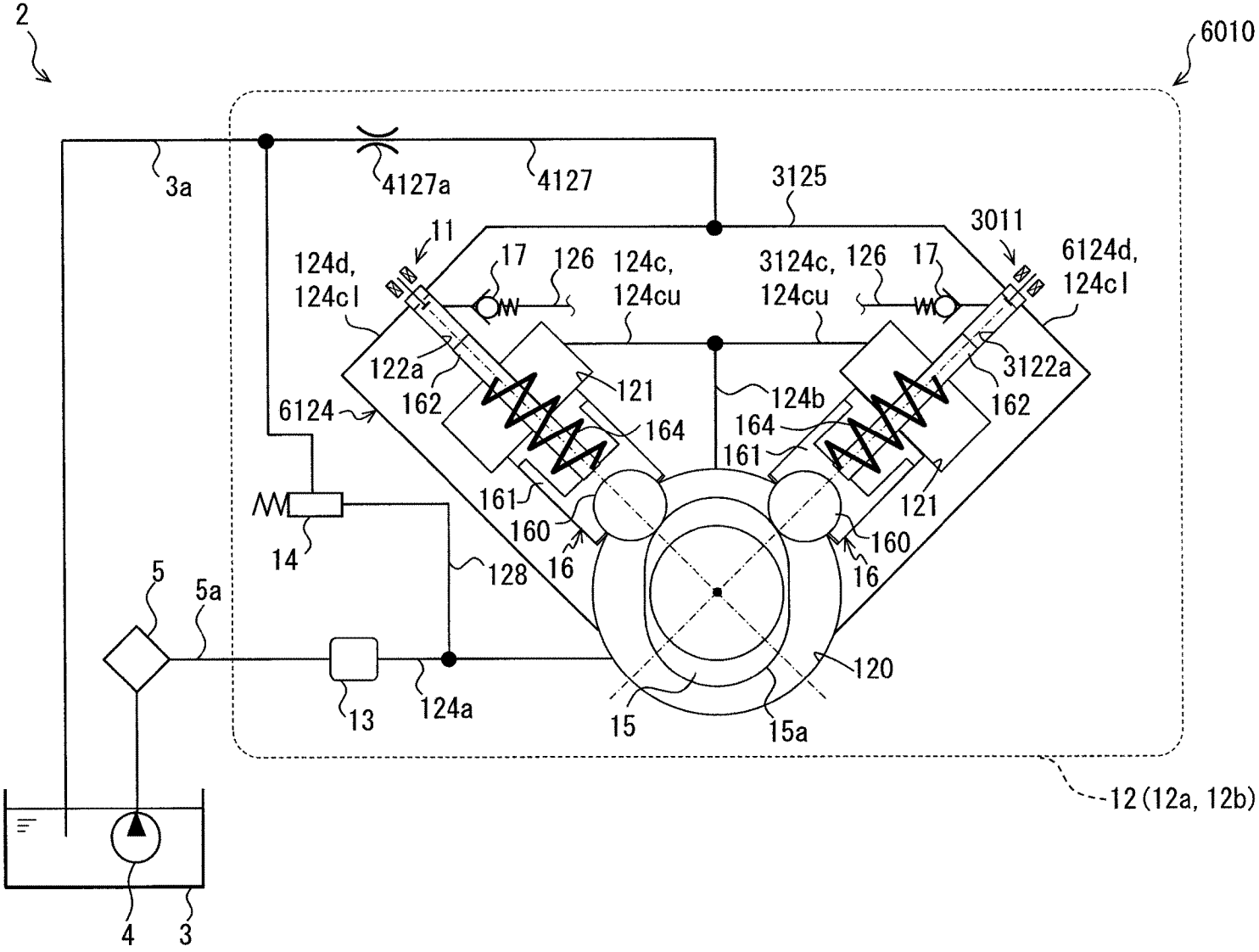
FIG. 12 is a structural diagram indicating a high pressure fuel pump according to a sixth embodiment.

As shown in FIG. 12, a sixth embodiment of the present disclosure is a modification of the fourth embodiment. In the suction passage 6124 of the high pressure fuel pump 6010 of the sixth embodiment, the downstream part 124*cl* of each of the primary and secondary branch passage portions 124*c*, 3124*c* of the fourth embodiment is modified to extend from the outer peripheral portion of the cam receiving chamber 120 to the corresponding valve installation hole 123 to form other primary and secondary branch passage portions 124*d*,

6124*d*, which are formed separately from the primary and secondary branch passage portions 124*c*, 3124*c*. In this way, the release passage 3125 is communicated with the other primary branch passage portion 124*d* through the primary control valve 11 and is communicated with the other secondary branch passage portion 6124*d* through the secondary control valve 3011. Each branch passage portion 124*d*, 6124*d* extends from a corresponding location of the casing 12*a*, which is displaced away from the location between the cylinders 12*b*, to the corresponding cylinder 12*b*.

In the sixth embodiment, which is constructed in the above described manner, the fuel, which is pumped from the low pressure fuel pump 4, can be drawn into the inlet passage portion 124*a*, the cam receiving chamber 120 and each branch passage portion 124*d*, 6124 in this order. Additionally, in the sixth embodiment, the fuel, which is pumped from the low pressure fuel pump 4, can be fed to the cam receiving chamber 120, the common passage portion 124*b*, each branch passage portion 124*c*, 3124*c* having only the upstream part 124*c*u, and each internal pressure variable chamber 121 in this order. The suction passage 6124 of the sixth embodiment supplies the fuel to each pressurizing chamber 122*a*, 3122*a* while the suction passage 6124 bypasses each internal pressure variable chamber 121 at the location on the upstream side of the corresponding branch passage portion 124*d*, 6124*d*, which forms the communicating connection relative to the release passage 3125.

According to the sixth embodiment, in the suction passage 6124 that bypasses each internal pressure variable chamber 121, in which the internal pressure is increased and decreased upon the driving of the movable unit 16 including the plunger 162, at the location on the upstream side of the communicating connection of the suction passage 6124 relative to the release passage 3125, it is less likely that the foreign objects, which are generated through the driving of the movable unit 16, are mixed into the fuel. Thus, it is possible to limit the deterioration in the backflow generation alleviating effect that would be caused by clogging of the release passage 3125 with the foreign objects mixed into the fuel in the suction passage 6124. As a result, the energy loss can be limited for a relatively long period of time.

Furthermore, according to the sixth embodiment, each branch passage portion 124*d*, 6124*d* of the suction passage 6124 can be placed at any location that is displaced from the location between the cylinders 12*b* in the pump body 12, so that this arrangement can contribute to the size reduction of the pump body 12.

Seventh Embodiment

Figure 13:
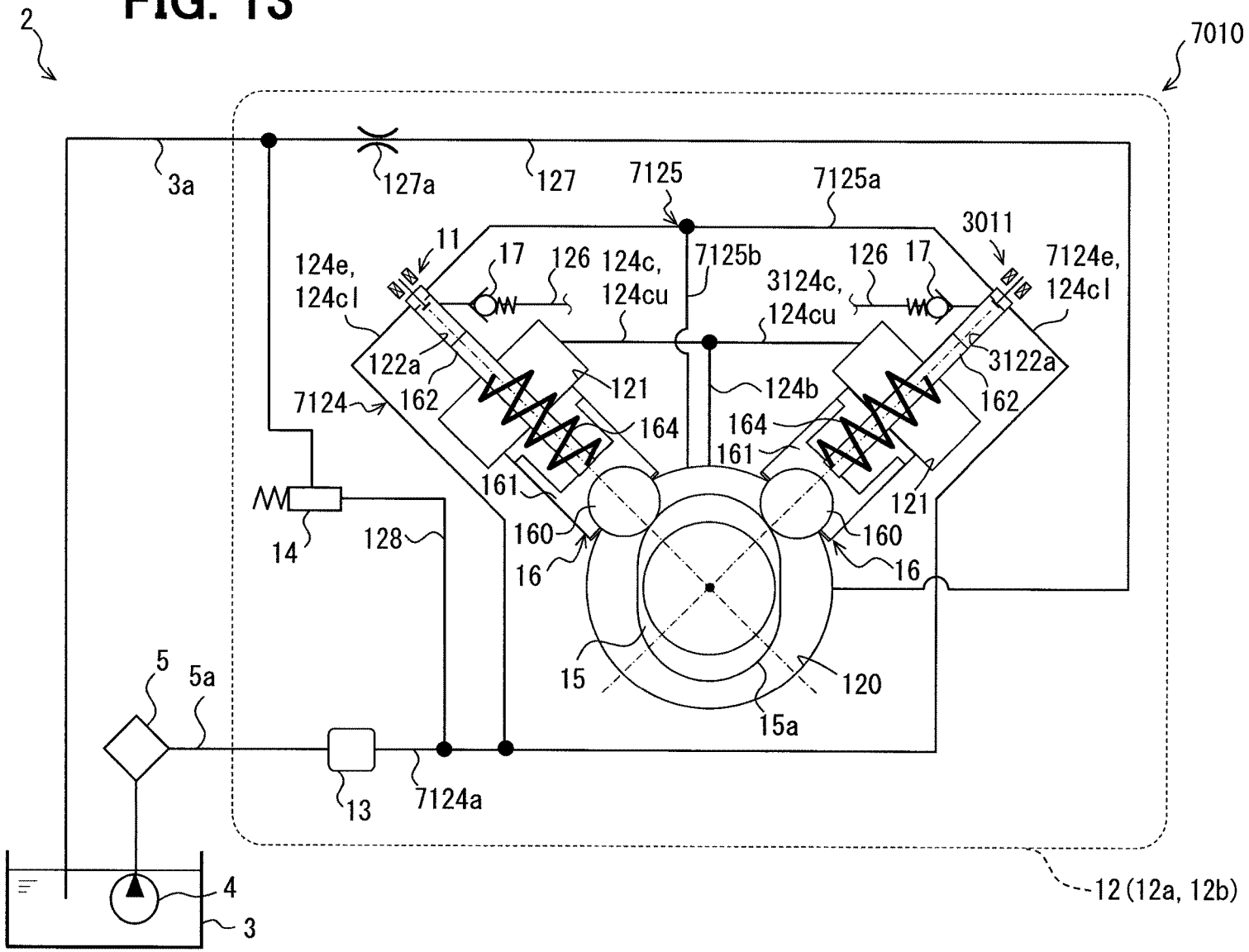
FIG. 13 is a structural diagram indicating a high pressure fuel pump according to a seventh embodiment.

As shown in FIG. 13, a seventh embodiment of the present disclosure is a modification of the third embodiment. In the suction passage 7124 of the high pressure fuel pump 7010 of the seventh embodiment, the downstream part 124*cl* of each of the primary and secondary branch passage portions 124*c*, 3124*c* of the third embodiment is modified to branch from a downstream end of the inlet passage portion 7124*a*, which does not extend to the outer peripheral portion of the cam receiving chamber 120, to form other primary and secondary branch passage portions 124*e*, 7124*e*, which are formed separately from the primary and secondary branch passage portions 124*c*, 3124*c*. Thereby, in the release passage 7125 of the seventh embodiment, a communication passage portion 7125*a*, which has substantially an identical configuration as that of the release passage 3125 of the third embodiment, is communicated with the other primary branch passage portion 124*e* through the primary control valve 11 and is communicated with the other secondary branch passage portion 7124*e* through the secondary control valve 3011. Each branch passage portion 124*e*, 7124*e* extends from a corresponding location of the casing 12*a*, which is displaced away from the location between the cylinders 12*b*, to the corresponding cylinder 12*b*.

In addition, a branch passage portion 7125*b* is added in the release passage 7125. This branch passage portion 7125*b* extends from an intermediate part of the communication passage portion 7125*a*, which is located between the branch passage portions 124*e*, 7124*e*, to the outer peripheral portion of the cam receiving chamber 120. Thereby, the common release passage 7125, which is common to the two pressurizing chambers 122*a*, 3122*a*, extends from the branch passage portion 7125*b* to the cam receiving chamber 120 and is thereby connected to the common drain passage 127 through the cam receiving chamber 120. The branch passage portion 7125*b* is formed at the location that is between the cylinders 12*b* in the casing 12*a*.

In the seventh embodiment discussed above, the fuel, which is pumped from the low pressure fuel pump 4, can be drawn into the inlet passage portion 7124*a* and the respective branch passage portions 124*e*, 7124*e*. Furthermore, in the seventh embodiment, the fuel, which is relieved from each branch passage portion 124*e*, 7124*e* to the communication passage portion 7125*a* of the release passage 7125, can be fed to the branch passage portion 7125*b*, the cam receiving chamber 120, the common passage portion 124*b*, each branch passage portion 124*c*, 3124*c* having only the upstream part 124*cu*, and each internal pressure variable chamber 121 in this order. Thus, the suction passage 7124 of the seventh embodiment supplies the fuel to each pressurizing chamber 122*a*, 3122*a* while the suction passage 7124 bypasses the cam receiving chamber 120 and each internal pressure variable chamber 121 at the location on the upstream side of the corresponding branch passage portion 124*e*, 7124*e*, which forms the communicating connection relative to the release passage 7125.

According to the seventh embodiment discussed above, in the suction passage 7124 that bypasses the cam receiving chamber 120, which receives the drive cam 15 for driving each of the plungers 162, at the location on the upstream side of each communicating connection of the suction passage 7124 relative to the release passage 7125, it is less likely that foreign objects, which are generated through the driving of the plungers 162, are mixed into the fuel. Thus, it is possible to limit the deterioration in the backflow generation alleviating effect that would be caused by clogging of the release passage 7125 with the foreign objects mixed into the fuel in the suction passage 7124. As a result, the energy loss can be limited for a relatively long period of time.

Furthermore, according to the seventh embodiment, in the suction passage 7124 that bypasses each internal pressure variable chamber 121, in which the internal pressure is increased and decreased upon the driving of the movable unit 16 including the plunger 162, at the location on the upstream side of the communicating connection of the suction passage 7124 relative to the release passage 7125, it is less likely that foreign objects, which are generated through the driving of the movable unit 16, are mixed into the fuel. Thus, it is possible to limit the deterioration in the backflow generation alleviating effect that would be caused by clogging of the release passage 7125 with the foreign objects mixed into the fuel.

Eighth Embodiment

Figure 14:
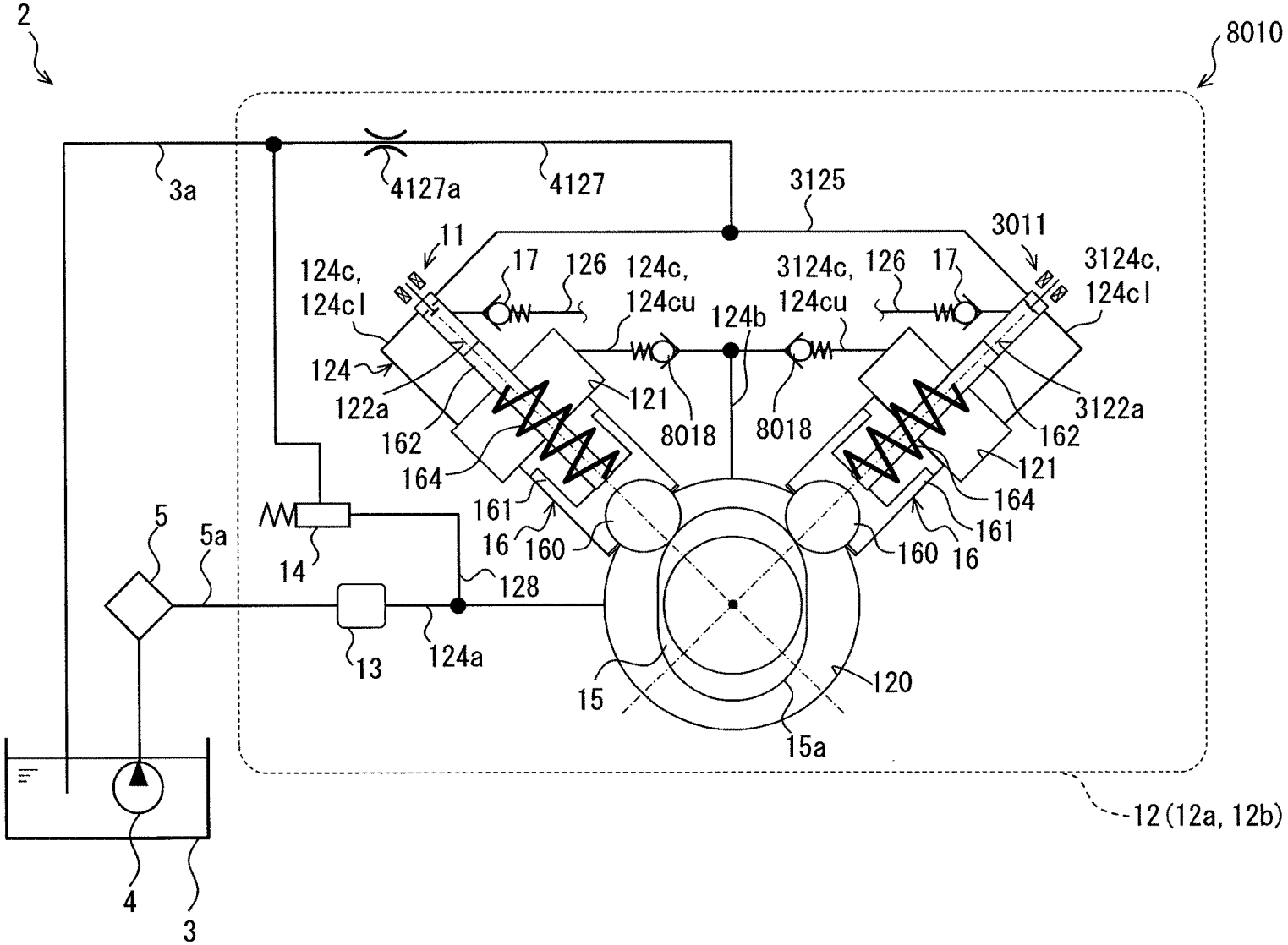
FIG. 14 is a structural diagram indicating a high pressure fuel pump according to an eighth embodiment.

As shown in FIG. 14, an eighth embodiment of the present disclosure is a modification of the fourth embodiment. The high pressure fuel pump 8010 of the eighth embodiment further includes a plurality of backflow limiting valves (more specifically two backflow limiting valves in this embodiment) 8018. Each of the backflow limiting valves 8018 is installed at the upstream part 124*c*u of the corresponding one of the primary and secondary branch passage portions 124*c*, 3124*c* in the suction passage 124. Each backflow limiting valve 8018 is a check valve that is mechanically operated. Each backflow limiting valve 8018 is opened to enable suctioning of the fuel into the downstream part 124*cl* of the corresponding branch passage portion 124*c*, 3124*c* when the pressure of the fuel, which is pumped from the low pressure fuel pump 4 through the low pressure filter 5, is a normal value (in a normal range) for the operating time of the low pressure fuel pump 4 and is higher than the pressure of the downstream part 124*cl* of the corresponding branch passage portion 124*c*, 3124*c*. In contrast, each backflow limiting valve 8018 is closed to limit the backflow of the fuel from the downstream part 124*cl* of the corresponding branch passage portion 124*c*, 3124*c* to the common passage portion 124*b* when the pressure of the downstream part 124*cl* of the branch passage portion 124*c*, 3124*c* becomes higher than the pressure of the fuel, which is pumped from the low pressure fuel pump 4.

As discussed above, in the suction passage 124 of the eighth embodiment, in which the backflow of the fuel is limited by the respective backflow limiting valves 8018, it is possible to enhance the backflow generation alleviating effect besides the relieving function of the release passage 3125 for relieving the return fuel from the respective pressurizing chambers 122*a*, 3122*a*. Thus, the reliability with respect to the advantage of limiting the energy loss can be improved.

Ninth Embodiment

Figure 15:
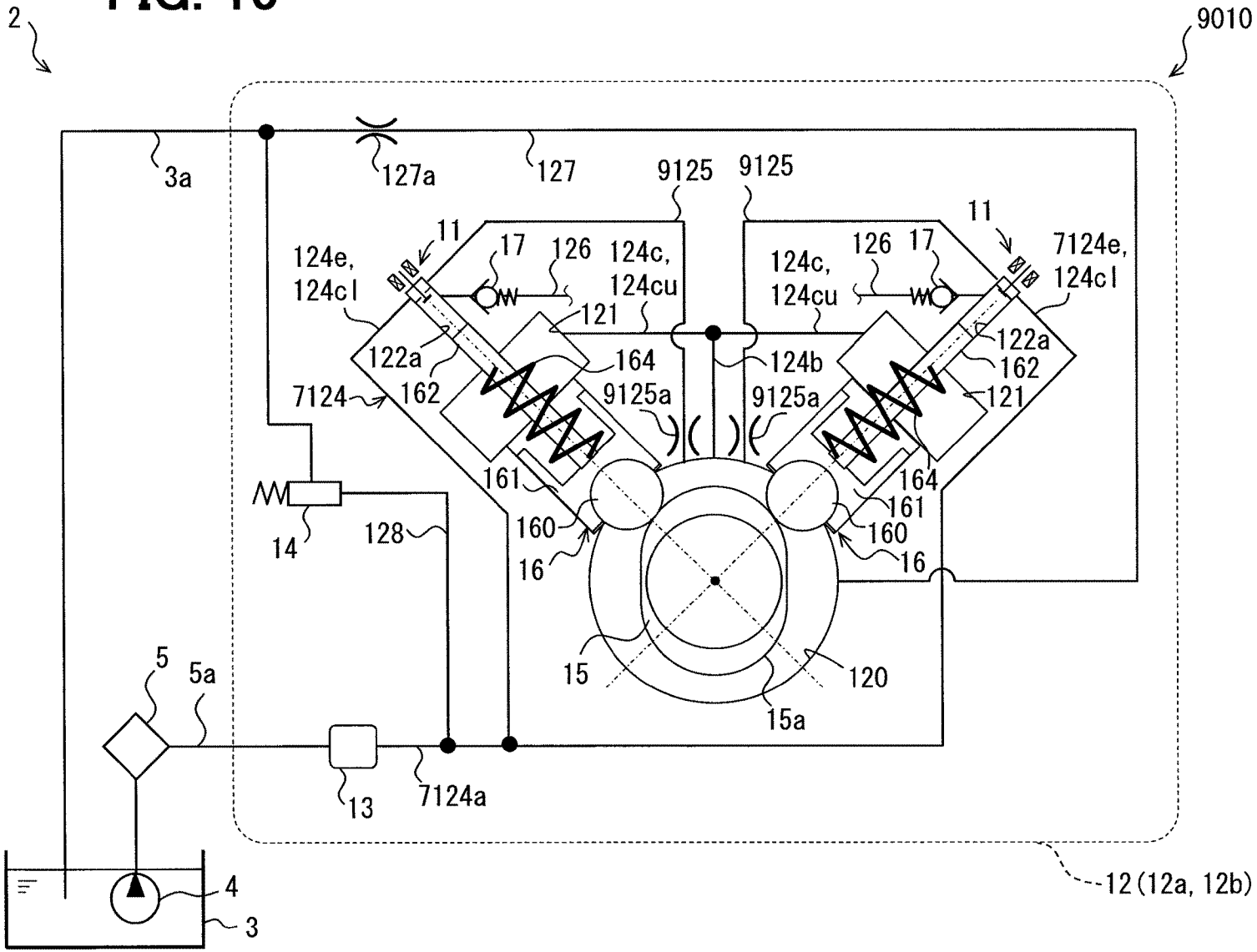
FIG. 15 is a structural diagram indicating a high pressure fuel pump according to a ninth embodiment.

As shown in FIG. 15, a ninth embodiment of the present disclosure is a modification of the first embodiment. In the high pressure fuel pump 9010 of the ninth embodiment, each of the two release passages 9125, which respectively correspond to the two pressurizing chambers 122*a*, has substantially the identical structure as that of the corresponding one of the two release passages 125 of the first embodiment except a difference discussed below. With this identical structure, the release passages 9125 are independently connected to the common cam receiving chamber 120 and are thereby connected to the common drain passage 127 through the cam receiving chamber 120. Each of the release passages 9125 of the ninth embodiment differs from the corresponding release passage 125 of the first embodiment with respect to a flow restricting portion 9125*a* formed at each of the release passages 9125.

In each flow restricting portion 9125*a* that has a reduced passage cross-sectional area at an intermediate part of the corresponding release passage 9125, which is located on the suction passage 124 side of the cam receiving chamber 120, this passage cross-sectional area is increased in comparison to the passage cross-sectional area of the flow restricting portion 127*a* of the drain passage 127. In other words, in the intermediate part of the drain passage 127, at which the flow restricting portion 127*a* is formed, the passage cross-sectional area is reduced in comparison to the passage cross-sectional area of the flow restricting portion 9125*a* of each release passage 9125.

In the ninth embodiment discussed above, the effects and advantages, which are similar to those of the first embodiment, can be achieved. Furthermore, in the ninth embodiment, the release passages 9125 are connected to the drain passage 127 through the cam receiving chamber 120, which receives the drive cam 15 for driving the plungers 162. In this way, the fuel, which is relieved from the pressurizing chamber 122*a* to the release passage 9125, can be further relieved to the cam receiving chamber 120, which has a relatively large volume, so that it is possible to reduce pressure pulsations generated in the flow of this fuel. Accordingly, it is possible to limit occurrence of an incident, in which the backflow generation alleviating effect at the suction passage 124 is interfered due to the fuel pressure pulsation, and thereby it is possible to limit the energy loss, which is caused by this interference.

Furthermore, according to the ninth embodiment, each flow restricting portion 9125*a* (serving as a release flow restricting portion) is formed by reducing the passage cross-sectional area of the corresponding portion of the corresponding release passage 9125 that is located on the suction passage 124 side of the cam receiving chamber 120 (i.e., on the side of the cam receiving chamber 120, at which the suction passage 124 is placed). Under this construction, the fuel of the pressurizing chamber 122*a* can be easily relieved into the cam receiving chamber 120, which has the lower internal pressure in comparison to the release passage 9125, through the release passage 9125. Thereby, the backflow generation alleviating effect for the fuel can be enhanced at the suction passage 124, so that the reliability with respect to the advantage of limiting the energy loss can be improved.

Furthermore, in the ninth embodiment, at least the portion of the drain passage 127, which is indirectly connected to each release passage 9125 through the cam receiving chamber 120, has the reduced passage cross-sectional area that is reduced in comparison to the passage cross-sectional area of the flow restricting portion 9125*a* of the release passage 9125. Specifically, the passage cross-sectional area of at least the portion of the drain passage 127, which can indirectly drain the fuel from each release passage 9125 through the cam receiving chamber 120, is reduced in comparison to the passage cross-sectional area of the flow restricting portion 9125*a*. Accordingly, the air, which is accumulated in the suction passage 124 and the pressurizing chambers 122*a* during the stop period (the non-operating period) of the low pressure fuel pump 4, is pressurized upon restarting of the operation of the low pressure fuel pump 4 and can be discharged into the release passages 9125, the cam receiving chamber 120, and the drain passage 127 in this order. Thus, it is possible to limit the deterioration in the fuel filling performance for filling the fuel into the pressurizing chambers 122*a*, which would be otherwise caused by interfering of the suctioning of the fuel into the suction passage 124 and the pressurizing chambers 122*a* by the accumulated air. Therefore, it is possible to limit the energy loss and the deterioration in the delivery performance of the fuel from each pressurizing chamber 122*a*.

In addition, in the high pressure fuel pump 9010 of the ninth embodiment, as shown in FIG. 15, in place of the suction passage 124 of the first embodiment, there is formed the suction passage 7124, which supplies the fuel to each pressurizing chamber 122*a* while the suction passage 7124 bypasses the cam receiving chamber 120 and each internal pressure variable chambers 121 at the location on the upstream side of each communicating connection of the suction passage 7124 relative to the corresponding release passage 9125 like in the seventh embodiment. In this way, the effects and advantages, which are similar to those of the seventh embodiment, can be achieved.

Tenth Embodiment

Figure 16:
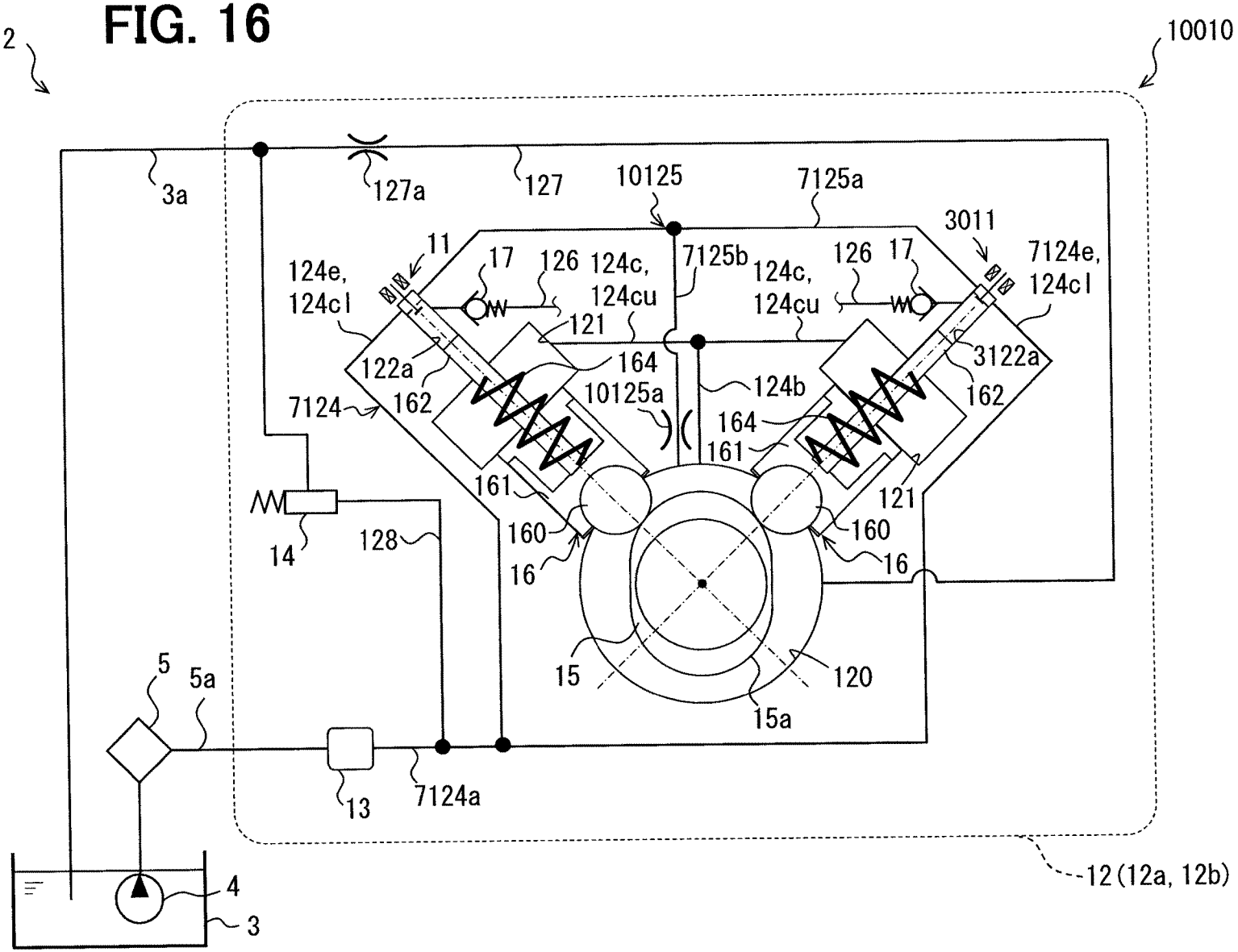
FIG. 16 is a structural diagram indicating a high pressure fuel pump according to a tenth embodiment.

As shown in FIG. 16, a tenth embodiment of the present disclosure is a modification of the seventh embodiment. In the high pressure fuel pump 10010 of the tenth embodiment, the common release passage 10125, which is common to the two pressurizing chambers 122*a*, 3122*a*, has substantially the identical structure as that of the release passage 7125 of the seventh embodiment. With this common structure, the release passage 10125 is connected from the branch passage portion 7125*b* to the common cam receiving chamber 120 and is thereby connected to the common drain passage 127 through the cam receiving chamber 120.

Here, like in the seventh embodiment, the suction passage 7124 supplies the fuel to each pressurizing chamber 122*a*, 3122*a* while the suction passage 7124 bypasses the cam receiving chamber 120 and each internal pressure variable chamber 121 at the location on the upstream side of the communicating connection of the suction passage 7124 relative to the release passage 10125. In this way, in a flow restricting portion 10125*a* that has a reduced passage cross-sectional area at the branch passage portion 7125*b* of the intermediate part of the release passage 10125, which is located on the suction passage 7124 side of the cam receiving chamber 120, the passage cross-sectional area of the flow restricting portion 10125*a* is increased in comparison to the passage cross-sectional area of the flow restricting portion 127*a* of the drain passage 127. In other words, in the intermediate part of the drain passage 127, at which the flow restricting portion 127*a* is formed, the passage cross-sectional area is reduced in comparison to the passage cross-sectional area of the flow restricting portion 10125*a* of the release passage 10125.

In the tenth embodiment discussed above, effects and advantages, which are similar to those of the seventh embodiment, can be achieved. Furthermore, in the tenth embodiment, the release passage 10125 is connected to the drain passage 127 through the cam receiving chamber 120, which receives the drive cam 15 for driving the plungers 162. In this way, a portion of the fuel, which is relieved from the pressurizing chamber 122*a*, 3122*a* to the release passage 10125, can be further relieved to the cam receiving chamber 120, which has the relatively large volume, so that it is possible to reduce the pressure pulsations generated in the flow of this fuel. Accordingly, it is possible to limit occurrence of the incident, in which the backflow generation alleviating effect at the suction passage 7124 is interfered due to the fuel pressure pulsation, and thereby it is possible to limit the energy loss, which is caused by this interference.

Furthermore, according to the tenth embodiment, the flow restricting portion 10125*a* (serving as the release flow restricting portion) is formed by reducing the passage cross-sectional area of the corresponding portion of the release passage 10125, which is located on the suction passage 7124 side of the cam receiving chamber 120. Under this construction, a portion of the fuel of the pressurizing chamber 122*a*, 3122*a* can be easily relieved into the cam receiving chamber 120, which has the lower internal pressure in comparison to the release passage 10125, through the release passage 10125. Thereby, the backflow generation alleviating effect for the fuel can be enhanced at the suction passage 7124, so that the reliability with respect to the advantage of limiting the energy loss can be improved.

Furthermore, in the tenth embodiment, at least the portion of the drain passage 127, which is indirectly connected to the release passage 10125 through the cam receiving chamber 120, has the reduced passage cross-sectional area that is reduced in comparison to the passage cross-sectional area of the flow restricting portion 10125*a* of the release passage 10125. Specifically, the passage cross-sectional area of at least the portion of the drain passage 127, which can indirectly drain the fuel from the release passage 10125 through the cam receiving chamber 120, is reduced in comparison to the passage cross-sectional area of the flow restricting portion 10125*a*. Accordingly, the air, which is accumulated in the suction passage 7124 and the pressurizing chambers 122*a*, 3122*a* during the stop period (the non-operating period) of the low pressure fuel pump 4, is pressurized upon restarting of the operation of the low pressure fuel pump 4 and can be discharged into the release passages 10125, the cam receiving chamber 120, and the drain passage 127 in this order. Thus, it is possible to limit the deterioration in the fuel filling performance for filling the fuel into the pressurizing chambers 122*a*, 3122*a*, which would be otherwise caused by interfering of the suctioning of the fuel into the suction passage 7124 and the pressurizing chambers 122*a*, 3122*a* by the accumulated air. Therefore, it is possible to limit the energy loss and the deterioration in the delivery performance of the fuel from each pressurizing chamber 122*a*, 3122*a*.

Eleventh Embodiment

Figure 17:
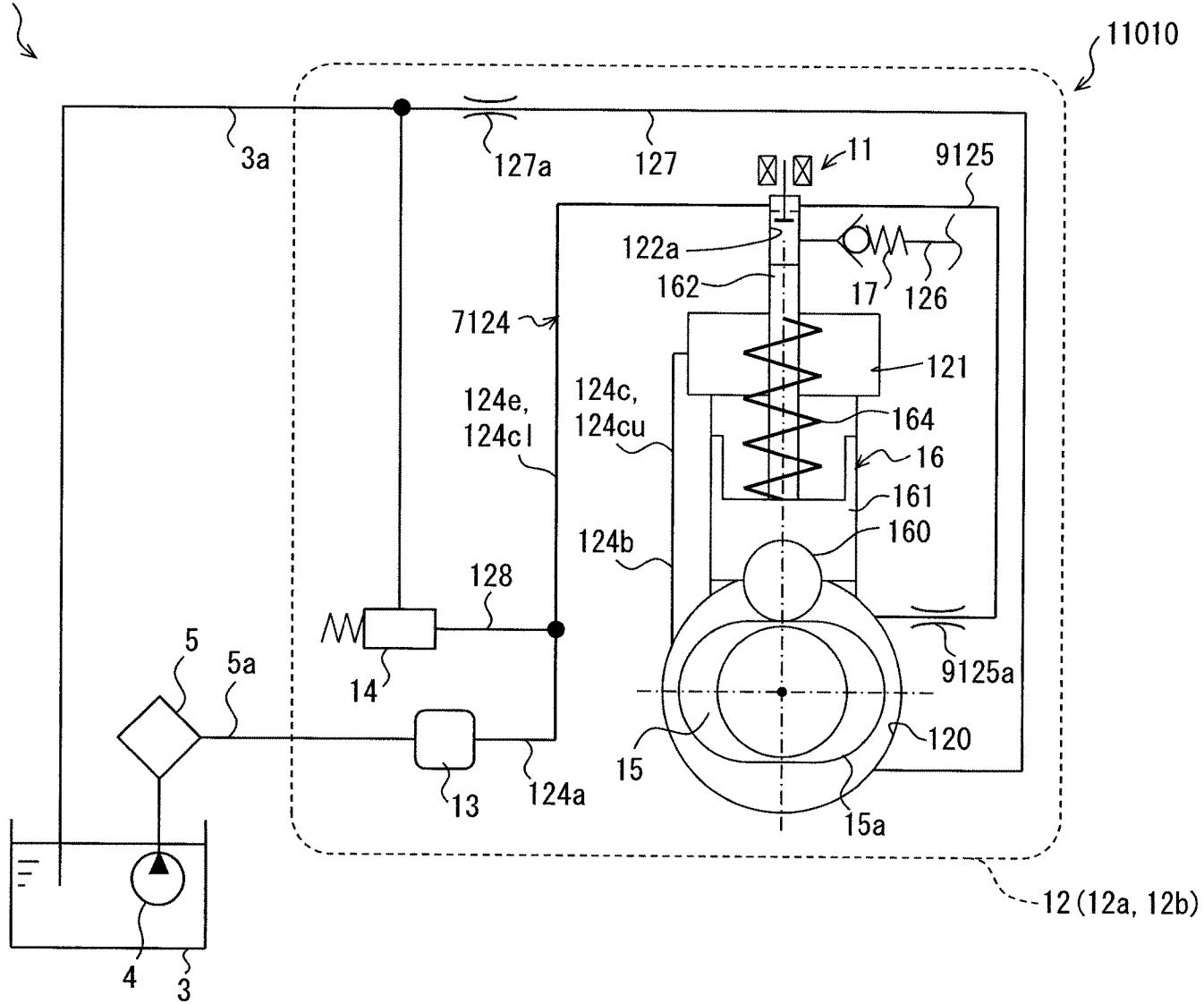
FIG. 17 is a structural diagram indicating a high pressure fuel pump according to an eleventh embodiment.
Figure 18:
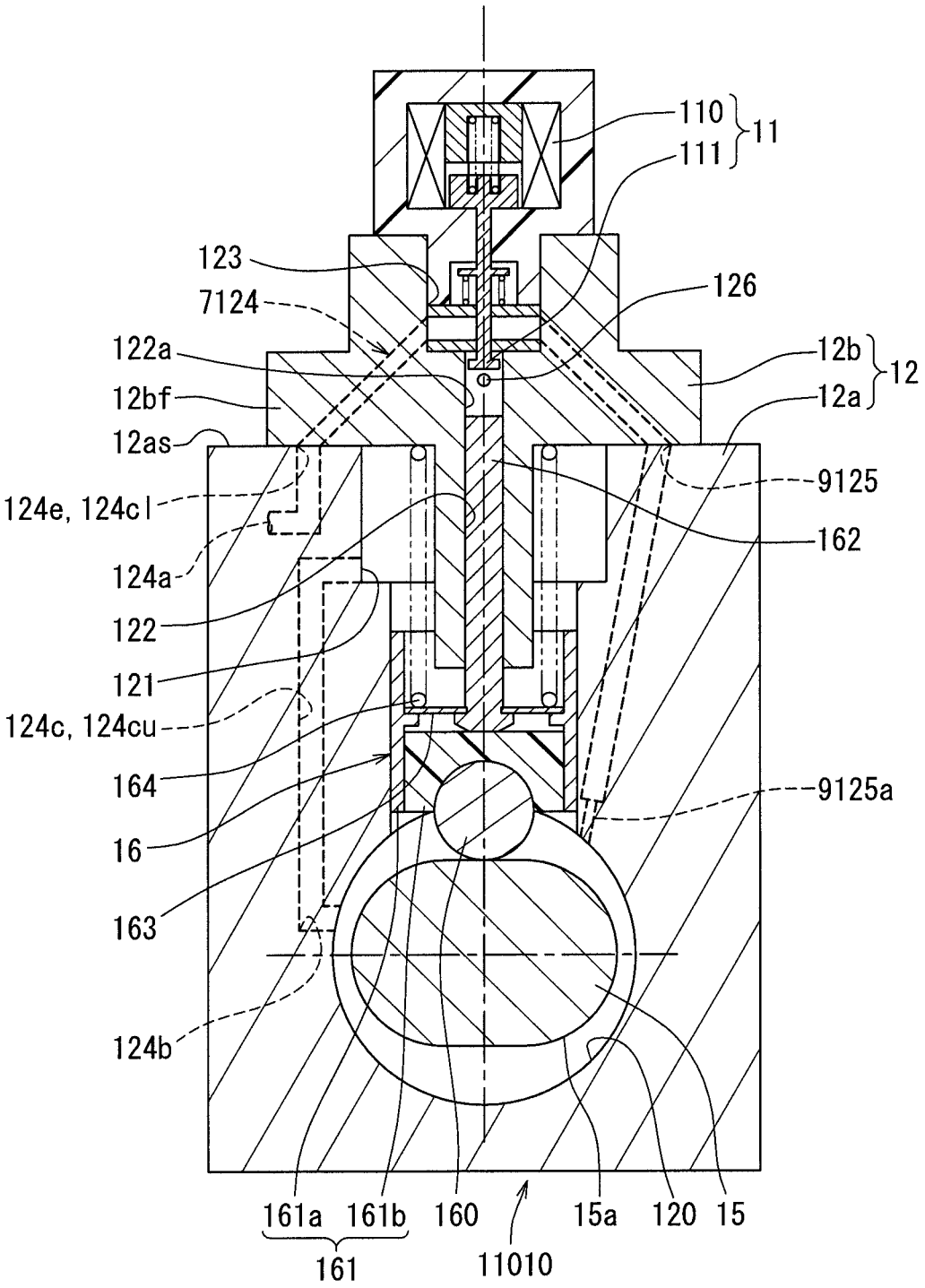
FIG. 18 is a cross-sectional view indicating the high pressure fuel pump according to the eleventh embodiment.

As shown in FIGS. 17, 18, an eleventh embodiment of the present disclosure is a modification of the ninth embodiment. The high pressure fuel pump 11010 of the eleventh embodiment includes only one component of each pair of the components 121, 12*b*, 124*c*, 9125, 126, 16, 17, 11, which are paired in the ninth embodiment. Therefore, the single release passage 9125, which extends from the corresponding single pressurizing chamber 122*a*, forms the flow restricting portion 9125*a* and is connected to the cam receiving chamber 120, so that the release passage 9125 is connected to the drain passage 127 through the cam receiving chamber 120. Therefore, the present embodiment can achieve effects and advantages, which are similar to those of the ninth embodiment.

Twelfth Embodiment

Figure 19:
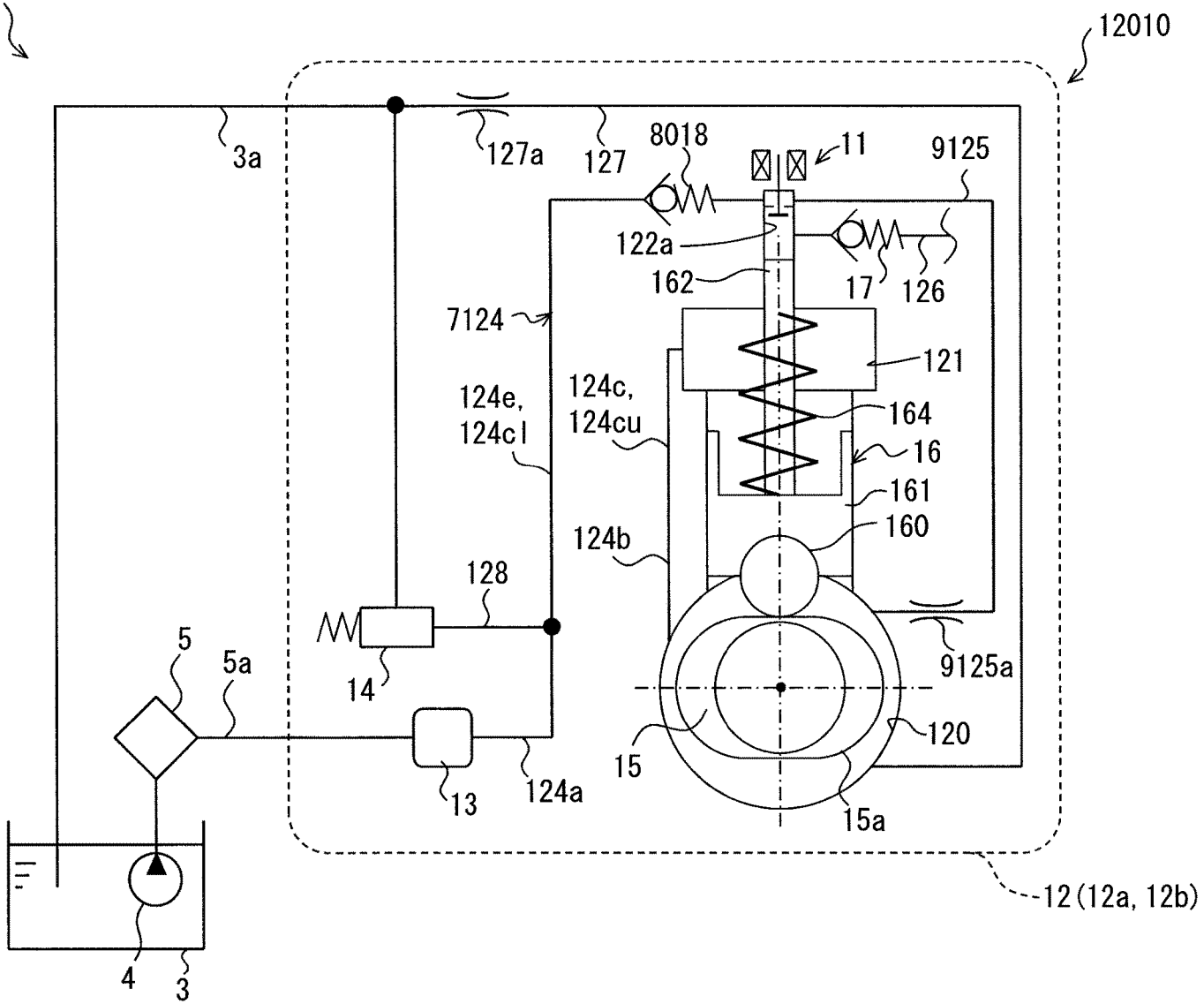
FIG. 19 is a structural diagram indicating a high pressure fuel pump according to a twelfth embodiment.

As shown in FIG. 19, a twelfth embodiment of the present disclosure is a modification of the eleventh embodiment. The high pressure fuel pump 12010 of the twelfth embodiment includes the backflow limiting valve 8018, which is similar to the backflow limiting valve 8018 of the eighth embodiment and is placed at the predetermined part 124*cl* of the primary branch passage portion 124*e* of the suction passage 7124. Therefore, the present embodiment can achieve effects and advantages, which are similar to those of the eighth embodiment.

Thirteenth Embodiment

Figure 20:
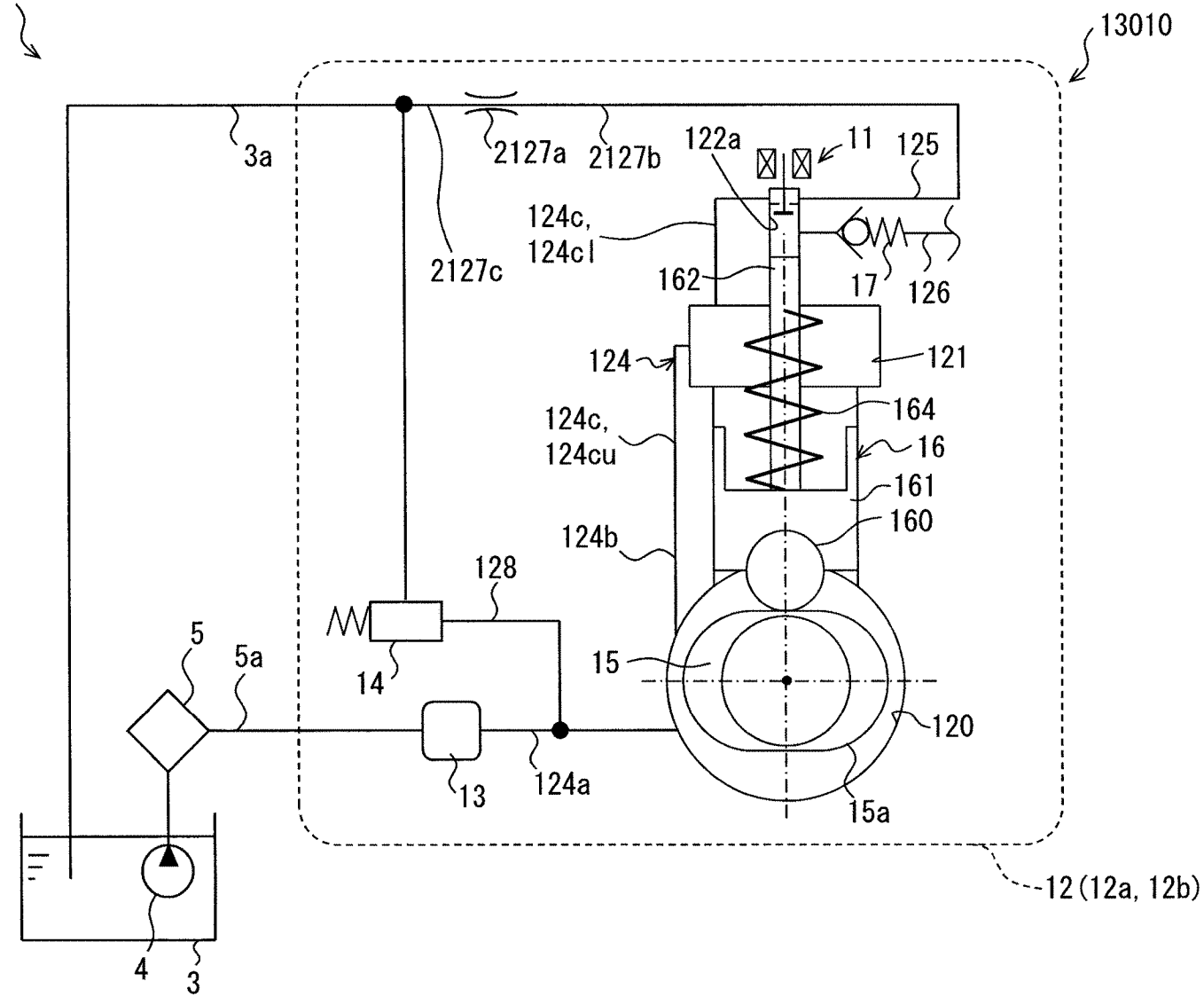
FIG. 20 is a structural diagram indicating a high pressure fuel pump according to a thirteenth embodiment.
Figure 21:
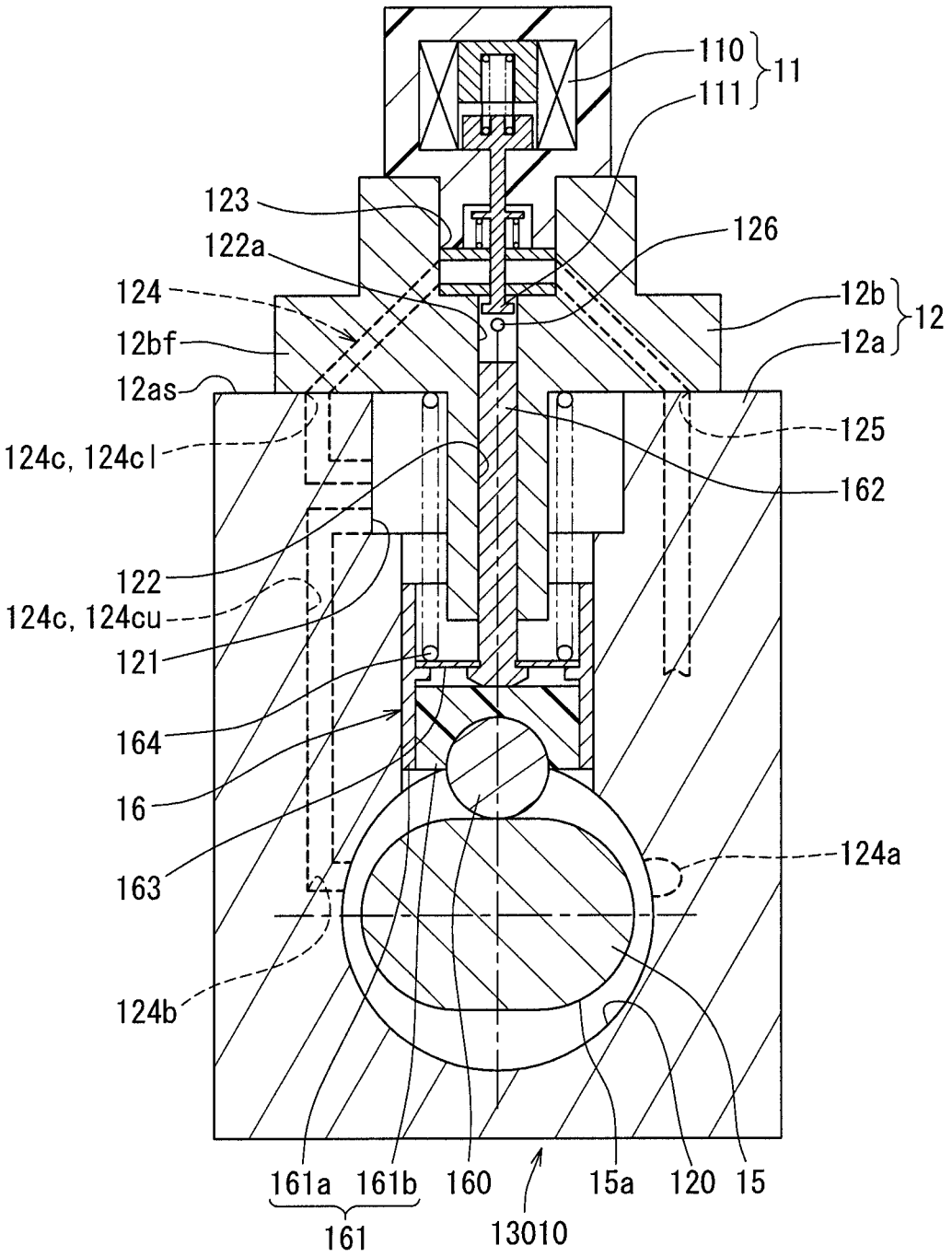
FIG. 21 is a cross-sectional view indicating the high pressure fuel pump according to the thirteenth embodiment.

As shown in FIGS. 20 and 21, a thirteenth embodiment of the present disclosure is a modification of the second embodiment. The high pressure fuel pump 13010 of the thirteenth embodiment includes only one component of each pair of the components 121, 12*b*, 124*c*, 125, 126, 16, 17, 11, 2127*a*, 2127*b*, which are paired in the second embodiment. Therefore, the single passage portion 2127*b* of the drain passage 2127, which has the flow restricting portion 2127*a*, extends from the downstream end of the single release passage 125, which extends from the corresponding single pressurizing chamber 122*a*, and the passage portion 2127*c* of the drain passage 2127 extends from the downstream end of the single passage portion 2127*b*. Here, it should be noted that the passage portion 2127*c* may possibly be eliminated from the drain passage 2127 of the thirteenth embodiment. Accordingly, the release passage 125 is directly connected to the drain passage 2127 while the release passage 125 is not connected to the cam receiving chamber 120. Therefore, the present embodiment can achieve effects and advantages, which are similar to those of the second embodiment.

Fourteenth Embodiment

Figure 22:
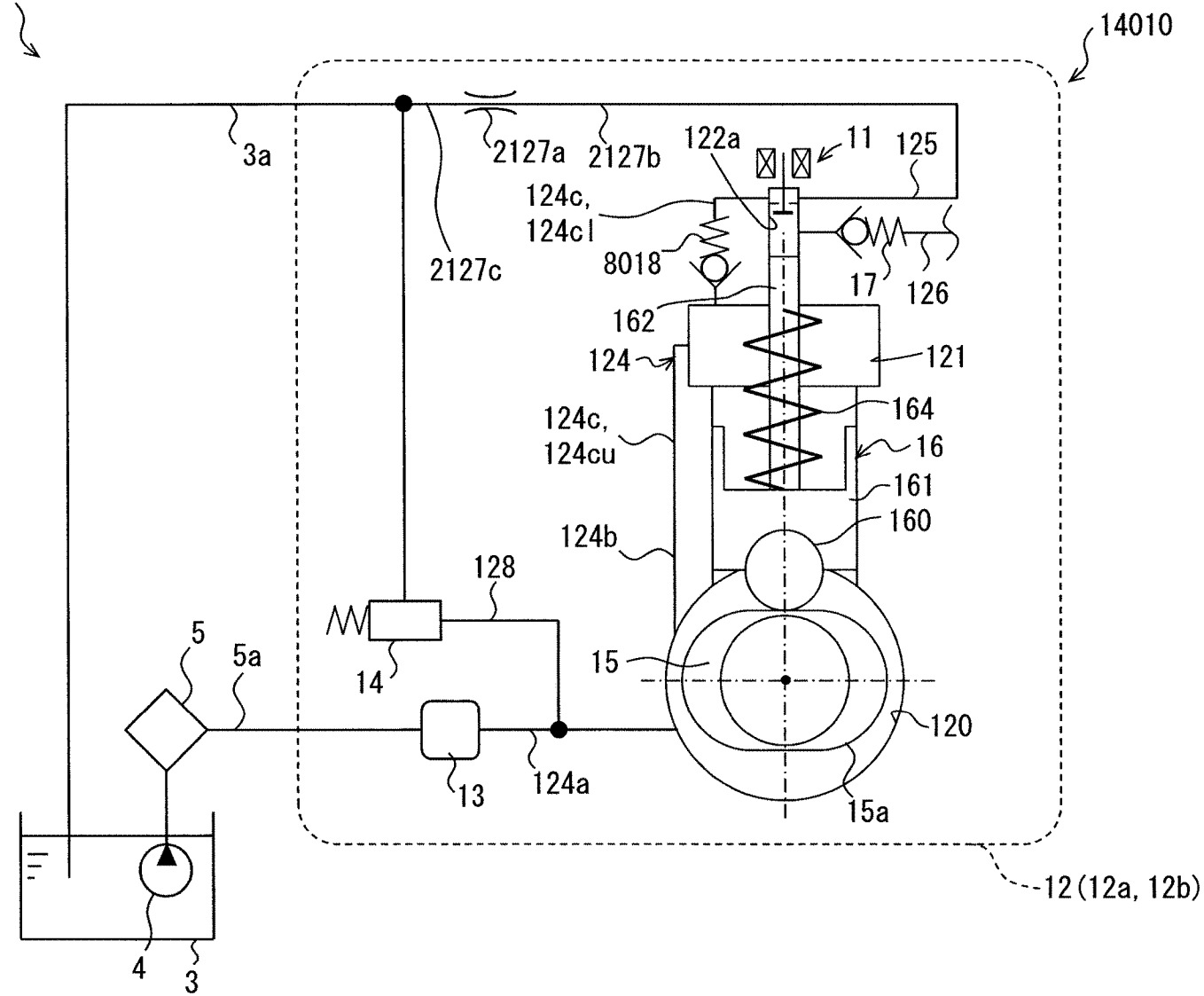
FIG. 22 is a structural diagram indicating a high pressure fuel pump according to a fourteenth embodiment.

As shown in FIG. 22, a fourteenth embodiment of the present disclosure is a modification of the thirteenth embodiment. The high pressure fuel pump 14010 of the fourteenth embodiment includes the backflow limiting valve 8018, which is similar to the backflow limiting valve 8018 of the eighth embodiment and is placed at the predetermined part 124*cl* of the branch passage portion 124*c* of the of the suction passage 124. Therefore, the present embodiment can achieve effects and advantages, which are similar to those of the eighth embodiment.

Fifteenth Embodiment

Figure 23:
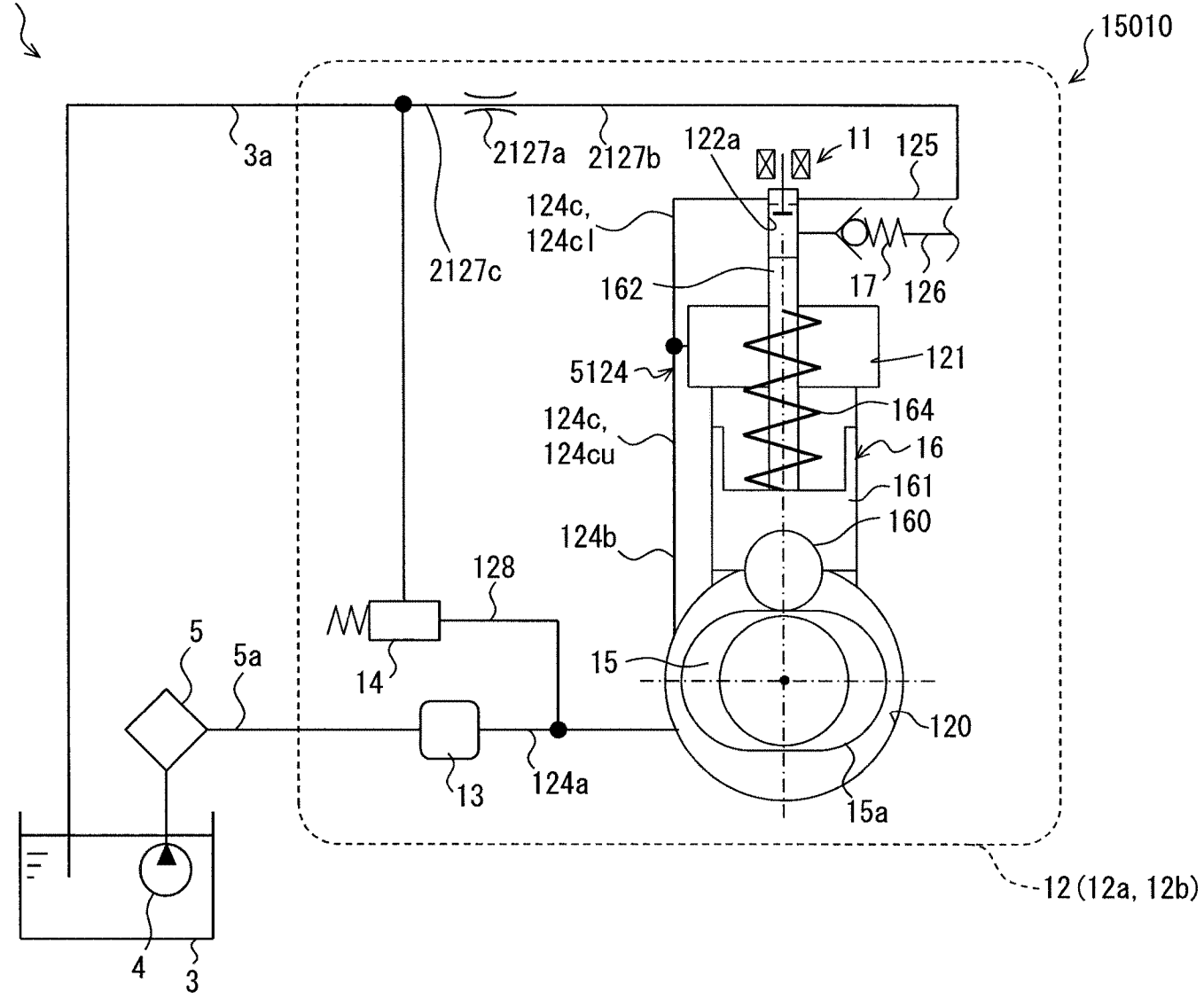
FIG. 23 is a structural diagram indicating a high pressure fuel pump according to a fifteenth embodiment.

As shown in FIG. 23, a fifteenth embodiment of the present disclosure is a modification of the thirteenth embodiment. In the high pressure fuel pump 15010 of the fifteenth embodiment, in place of the suction passage 124 of the thirteenth embodiment, there is provided the suction passage 5124 that supplies the fuel to the pressurizing chamber 122*a* while the suction passage 5124 bypasses the internal pressure variable chamber 121 at the location on the upstream side of the predetermined part 124*cl* of the branch passage portion 124*c*, which is the communicating connection relative to the release passage 125 like in the fifth embodiment. In this way, effects and advantages, which are similar to those of the fifth embodiment, can be achieved.

Sixteenth Embodiment

Figure 24:
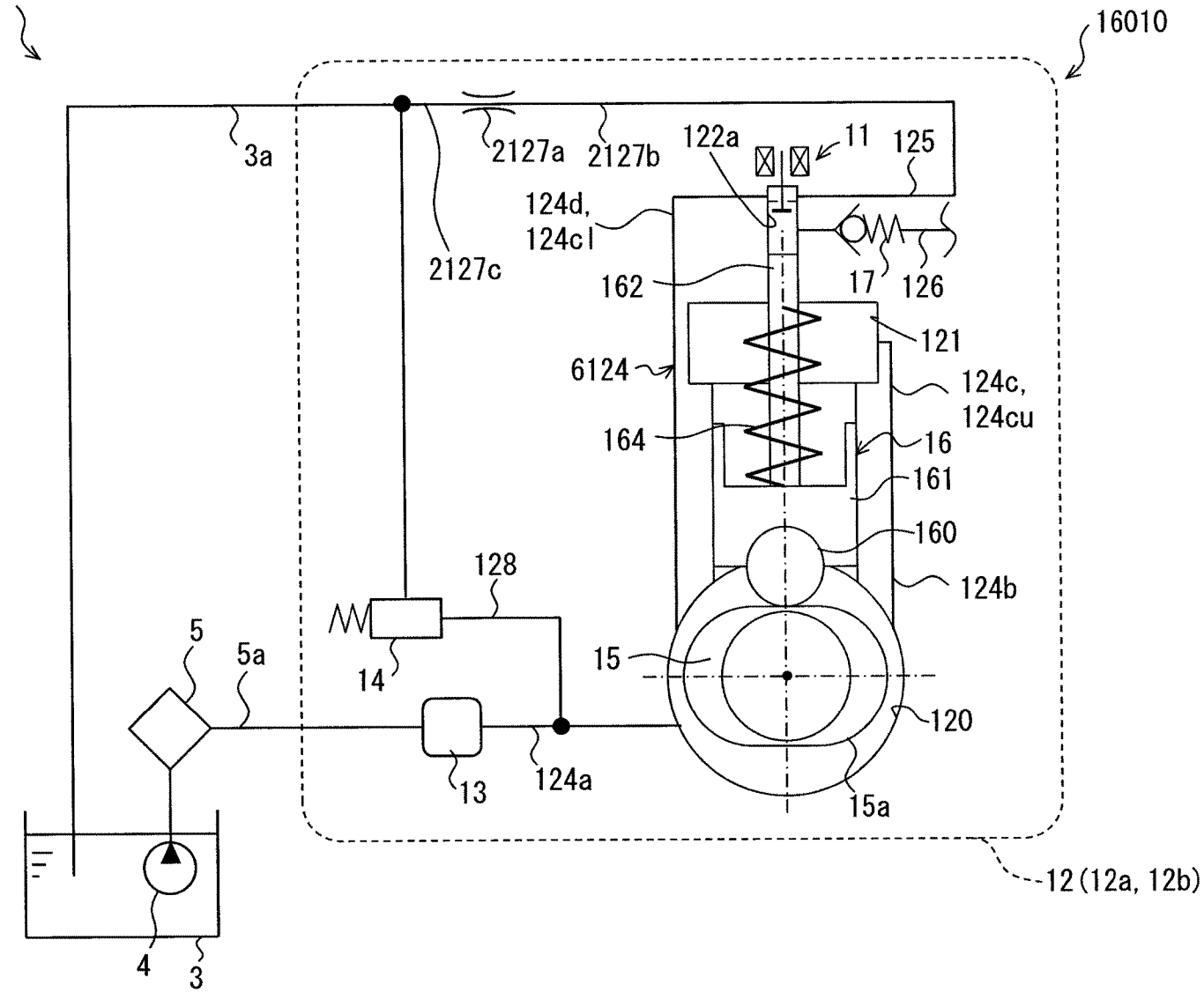
FIG. 24 is a structural diagram indicating a high pressure fuel pump according to a sixteenth embodiment.

As shown in FIG. 24, a sixteenth embodiment of the present disclosure is a modification of the thirteenth embodiment. In the high pressure fuel pump 16010 of the sixteenth embodiment, in place of the suction passage 124 of the thirteenth embodiment, there is provided the suction passage 6124 that supplies the fuel to the pressurizing chamber 122*a* while the suction passage 6124 bypasses the internal pressure variable chamber 121 at the location on the upstream side of the branch passage portion 124*d*, which is the communicating connection relative to the release passage 125 like in the sixth embodiment. In this way, effects and advantages, which are similar to those of the sixth embodiment, can be achieved.

OTHER EMBODIMENTS

The embodiments of the present disclosure have been described. However, the present disclosure is not necessarily limited to these embodiments and may be applied to various other embodiments and combinations of the above embodiments and/or the various other embodiments within a scope of the present disclosure.

Specifically, in a first modification with respect to the first to third and ninth embodiments, the suction passage 5124 and the primary and secondary branch passage portions 124*c*, 3124*c* of the fifth embodiment may be used. In a second modification with respect to the first to third and ninth embodiments, the primary and secondary branch passage portions 124*c*, 3124*c* of the suction passage 6124 and the other primary and secondary branch passage portions 124*d*, 6124*d* of the suction passage 6124 of the sixth embodiment may be used.

In a third modification with respect to the first, second and fourth embodiments, the primary and secondary branch passage portions 124*c*, 3124*c* of the suction passage 7124 and the other primary and secondary branch passage portions 124*e*, 7124*e* of the suction passage 7124 of the seventh embodiment may be used. In a fourth modification with respect to the ninth and tenth embodiments, the primary and secondary branch passage portions 124*c*, 3124*c* each having both of the upstream part 124*c*u and the downstream part 124*cl* of the suction passage 124 of the first embodiment may be used.

Figure 25:
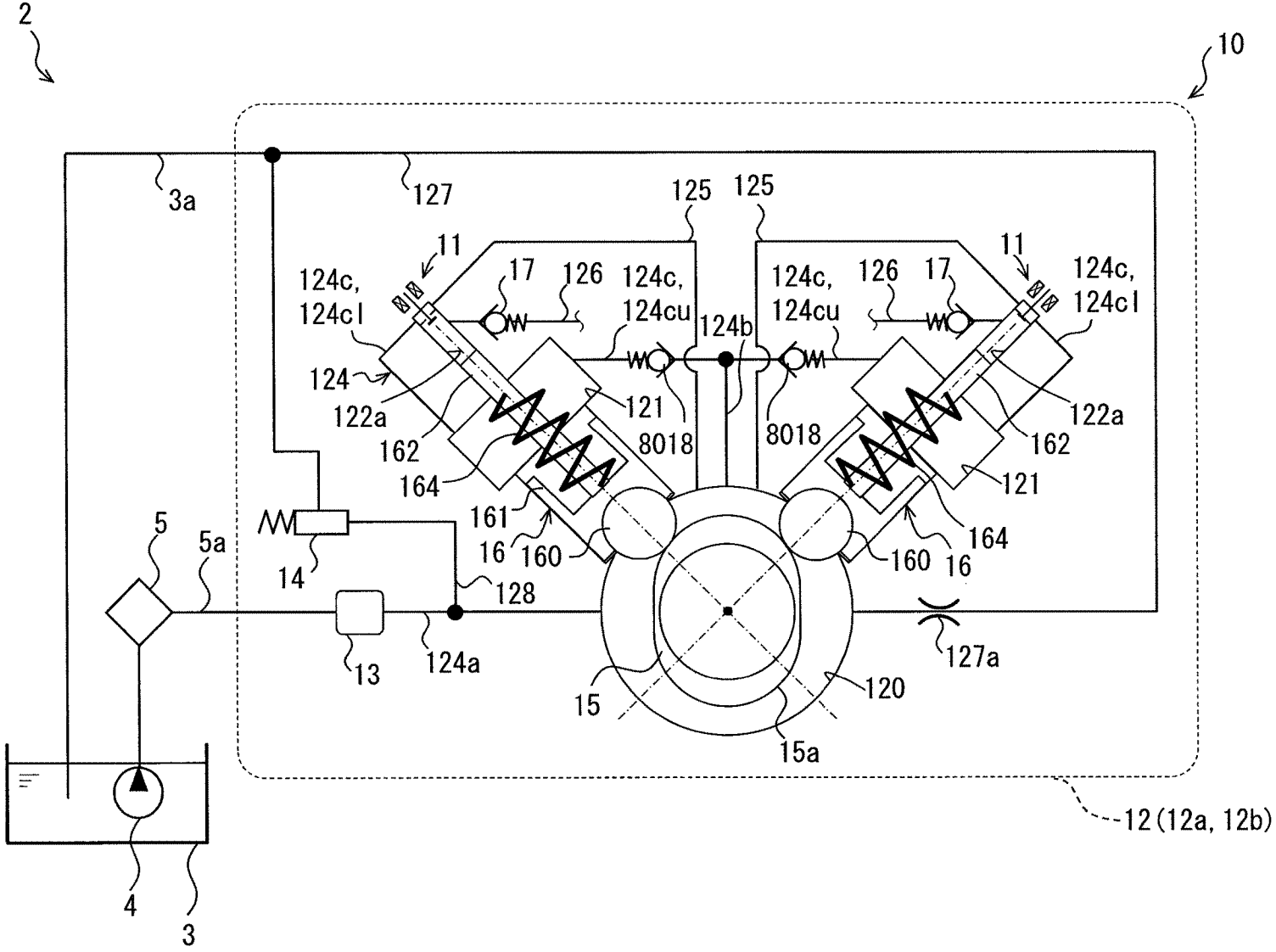
FIG. 25 is a structural diagram indicating a high pressure fuel pump according to a modification of FIG. 2.

In a fifth modification with respect to the first to third, fifth to seventh, ninth, tenth, fifteenth and sixteenth embodiments, as shown in FIG. 25 (showing the fifth modification of the first embodiment), the backflow limiting valve 8018 of the eighth embodiment may be installed at the suction passage 124, 5124, 6124, 7124 (e.g., the predetermined part 124*c*u or 124*cl* of each branch passage portion 124*c*, 124*d*, 124*e*, 3124*c*, 6124*d*, 7124*e*). In a sixth modification with respect to the first and second embodiments, only one corresponding component of each pair of the components discussed in the above description may be provided.

In a seventh modification with respect to the first, second and ninth embodiments, the time period of executing the delivery stroke in the one of the pressurizing chambers 122*a* may be partially or completely overlapped with the time period of executing the delivery stroke in the other one of the pressurizing chambers 122*a*. In an eighth modification with respect to the third to eighth and thirteenth embodiments, the time period of executing the delivery stroke in the one of the pressurizing chambers 122*a*, 3122*a* may be partially overlapped with the time period of executing the delivery stroke in the other one of the pressurizing chambers 122*a*, 3122*a*.

Figure 26:
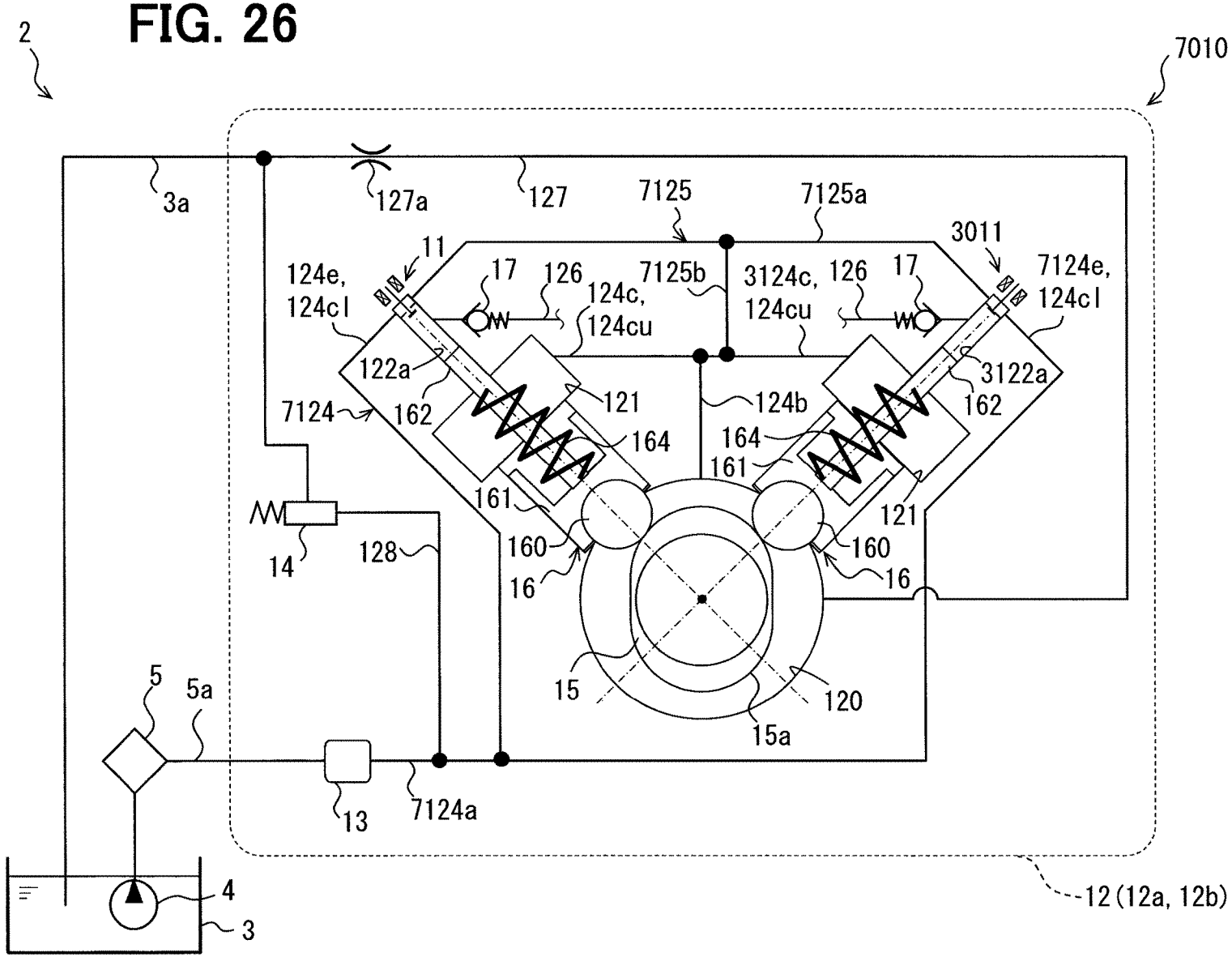
FIG. 26 is a structural diagram indicating a high pressure fuel pump according to a modification of FIG. 13.

In a ninth modification with respect to the seventh and tenth embodiments, as shown in FIG. 26 (showing the ninth modification of the seventh embodiment), the branch passage portion 7125*b* may be configured to extend from the intermediate part of the communication passage portion 7125*a* of the release passage 7125 to one (in FIG. 26, the secondary branch passage portion 3124*c*) of the common passage portion 124*b* and the branch passage portions 124*c*, 3124*c*. In this case, the branch passage portion 7125*b* of the release passage 7125 is connected to the drain passage 127 through the passage portion 124*b* and the cam receiving chamber 120.

Figure 27:
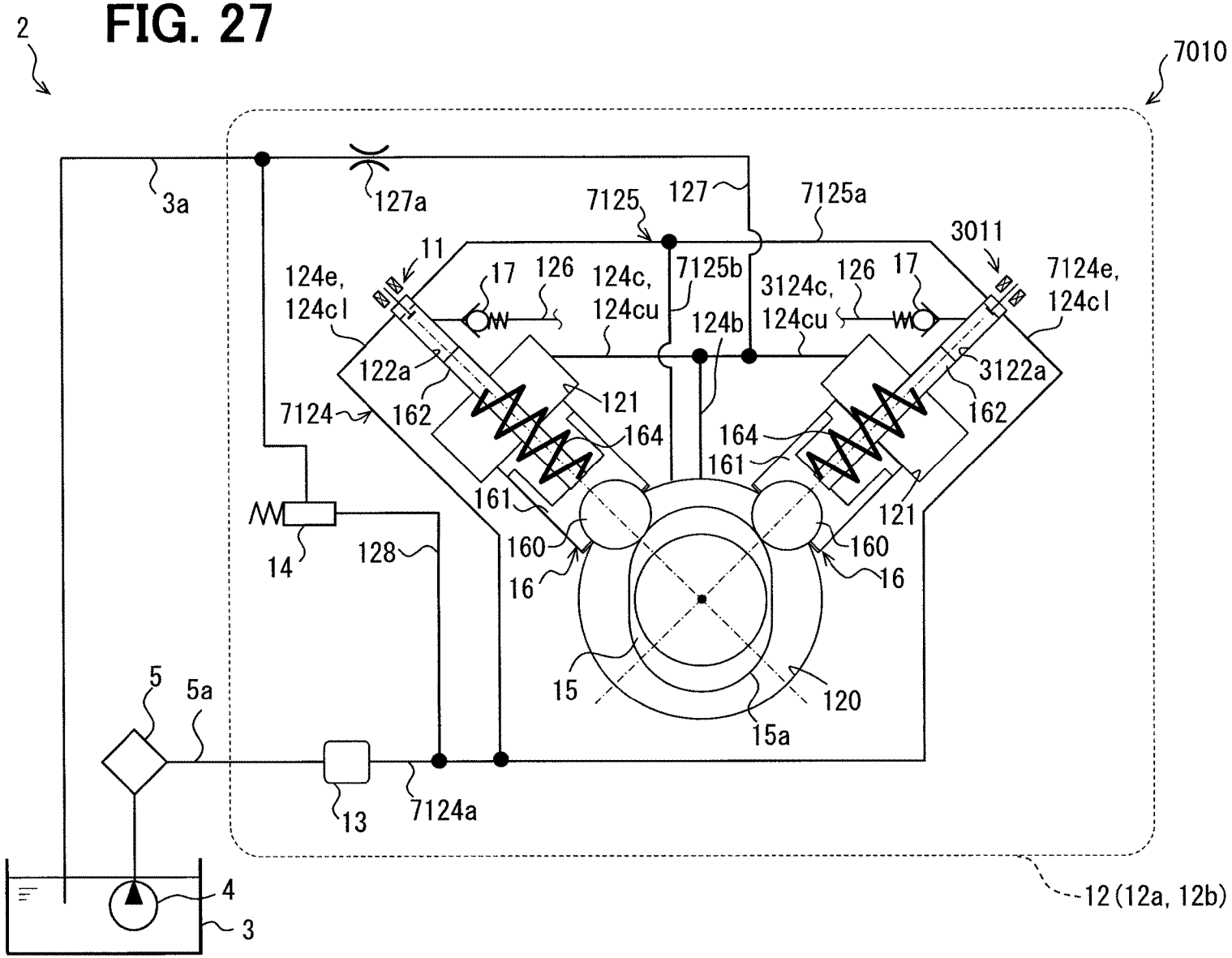
FIG. 27 is a structural diagram indicating a high pressure fuel pump according to a modification of FIG. 13.

In a tenth modification with respect to the seventh and tenth embodiments, as shown in FIG. 27 (showing the tenth modification of the seventh embodiment), the drain passage 127 may be configured to extend form one (in FIG. 27, the secondary branch passage portion 3124*c*) of the common passage portion 124*b* and the branch passage portions 124*c*, 3124*c* to the drain pipe that projects from the casing 12*a* to the outside of the casing 12*a*. In this case, the branch passage portion 7125*b* of the release passage 7125 is connected to the drain passage 127 through the cam receiving chamber 120 and the passage portion 124*b*.

Figure 28:
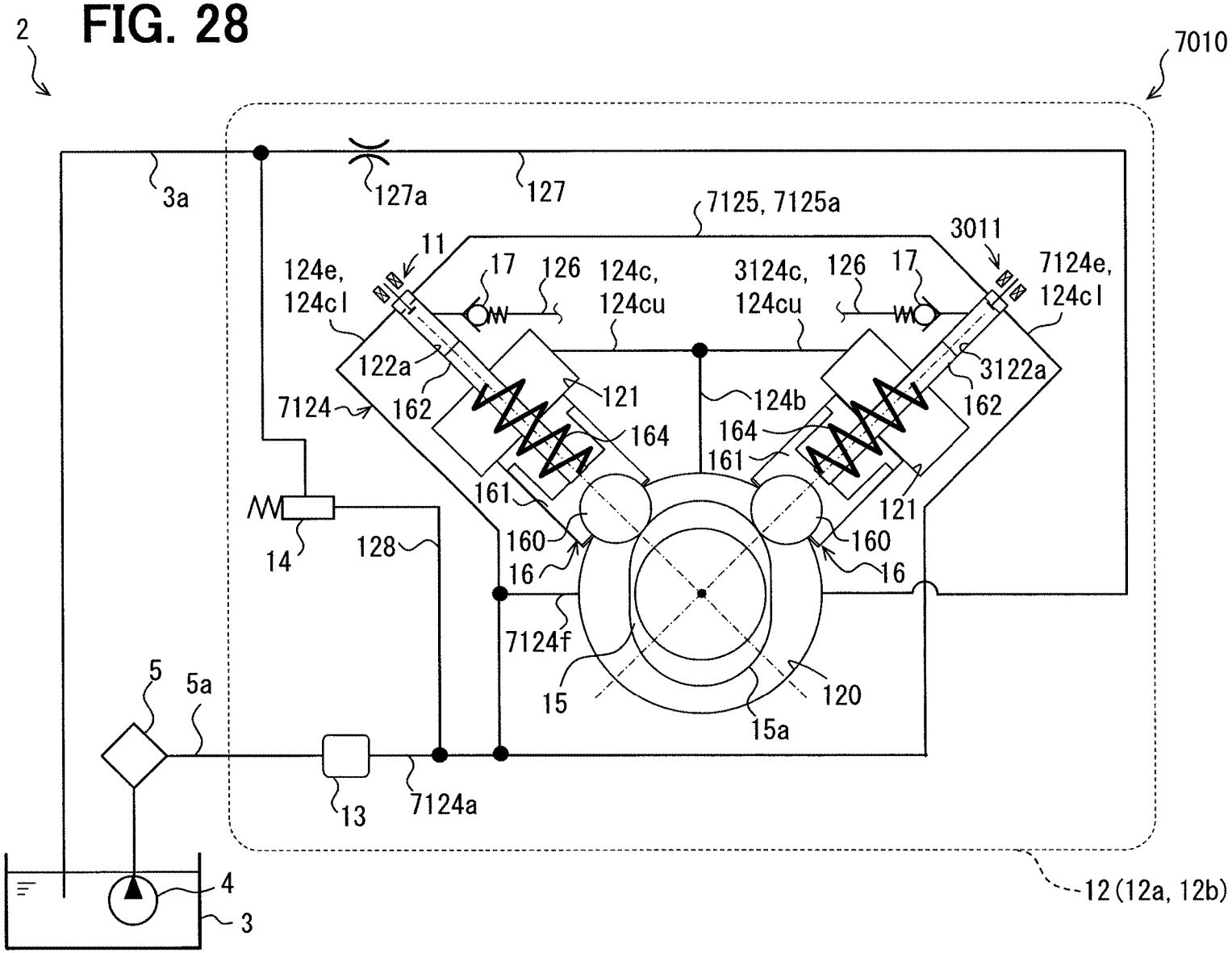
FIG. 28 is a structural diagram indicating a high pressure fuel pump according to a modification of FIG. 13.
Figure 29A:
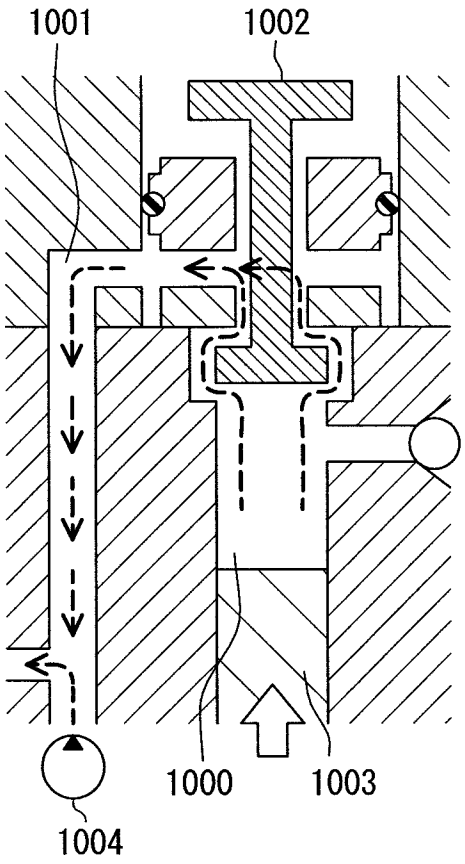
FIG. 29A RELATED ART
FIG. 29A to 29C are cross-sectional views for describing an objective to be addressed by the disclosure of the present application.
Figure 29B:
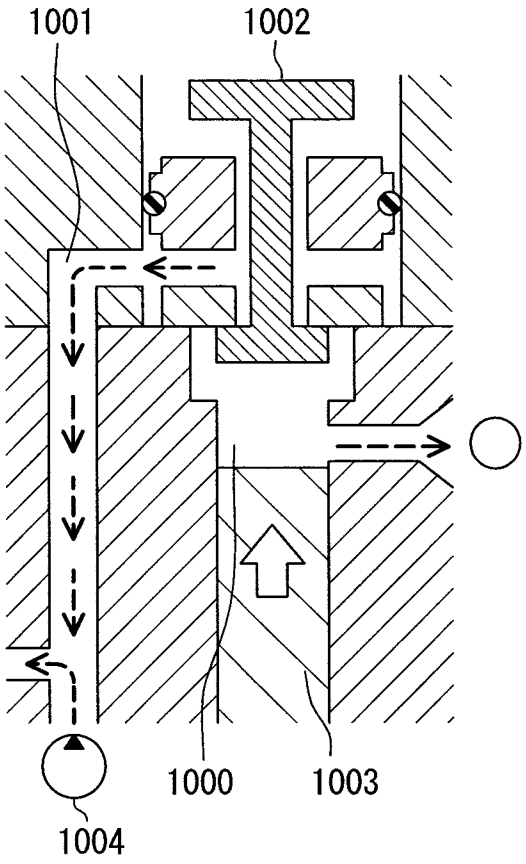
FIG. 29B RELATED ART
Figure 29C:
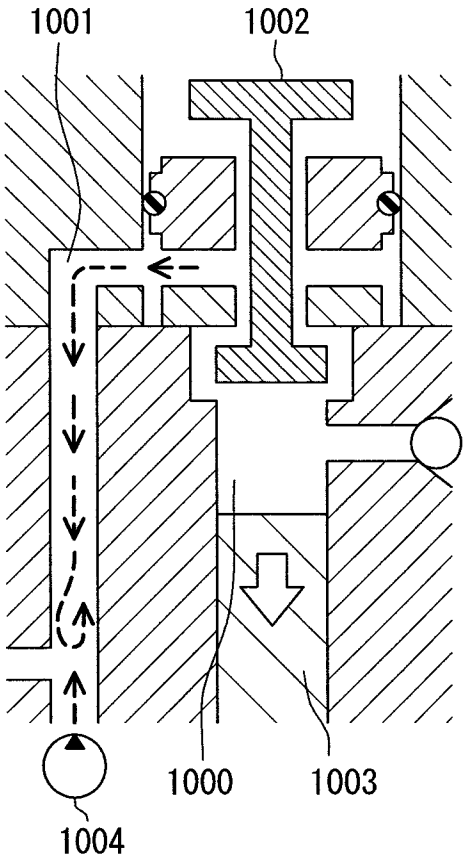
FIG. 29C RELATED ART

In an eleventh modification with respect to the seventh and tenth embodiments, as shown in FIG. 28 (showing the eleventh modification of the seventh embodiment), in place of the branch passage portion 7125*b*, there may be provided an inlet passage portion 7124*f* that extends from one (the primary branch passage portion 124*e* in FIG. 28) of the inlet passage portion 7124*a* and the branch passage portions 124*e*, 7124*e* to the outer peripheral portion of the cam receiving chamber 120. In a twelfth modification with respect to the first, second, fourth and ninth embodiments, the third modification, in which one of the ninth to eleventh modifications is added, may be implemented.

In a thirteenth modification with respect to the ninth, eleventh and twelfth embodiments, the release passages 9125 (i.e., the release passages 125 of the first embodiment), each of which does not have the flow restricting portion 9125*a*, may be used. In a fourteenth modification with respect to the first to sixteenth embodiments, the valve opening degree may be adjusted by the control valve 11 in the pre-stroke period ΔTp of the delivery stroke.

In a fifteenth modification with respect to the first to sixteenth embodiments, the valve opening degree may be changed by the control valve 11 at the pre-stroke period ΔTp of the delivery stroke and also the suction stroke. In a sixteenth modification with respect to the first to sixteenth embodiments, the passage cross-sectional area of the drain passage 127, 2127, 4127 at any location along the extent of the drain passage 127, 2127, 4127 (i.e., any location in a longitudinal direction, or a passage direction of the drain passage 127, 2127, 4127) may be reduced in comparison to the passage cross-sectional area of the release passage 125, 3125, 7125, 9125, 10125.

In a seventeenth modification with respect to the first to sixteenth embodiments, the mechanical pump or the electric pump, which is provided in the high pressure fuel pump 10, 2010, 3010, 4010, 5010, 6010, 7010, 8010, 9010, 10010, 11010, 12010, 13010, 14010, 15010, 16010, may be used as the low pressure fuel pump 4. In an eighteenth modification with respect to the first to sixteenth embodiments, the high pressure fuel pump 10, 2010, 3010, 4010, 5010, 6010, 7010, 8010, 9010, 10010, 11010, 12010, 13010, 14010, 15010, 16010 may be used in the fuel supply system 2 that supplies gasoline, which serves as the fuel, to a gasoline engine, which serves as the internal combustion engine 1.

What is claimed is:

1. A high pressure fuel pump for delivering fuel, which is suctioned into a pressurizing chamber from a low pressure fuel pump through a suction passage, to a supply destination after pressurizing the fuel in the pressurizing chamber with a plunger, the high pressure fuel pump comprising:

a pump body that slidably supports the plunger and forms the suction passage, the pressurizing chamber, a cam receiving chamber, a release passage, an internal pressure variable chamber and a communication passage, wherein the pressurizing chamber is communicated with the suction passage and the release passage through a connection, and the release passage is communicated with the cam receiving chamber which receives a drive cam that is configured to drive the plunger, and an internal pressure of the internal pressure variable chamber is increased and decreased in response to reciprocation of the plunger, and the communication passage communicates between the internal pressure variable chamber and the cam receiving chamber;

a control valve that is configured to open and close the connection; and a controller that is configured to control an operation of the control valve, wherein:

the controller is configured to place the control valve in an opening state where the control valve opens the connection to supply the fuel from the suction passage to the pressurizing chamber through the connection in a suction stroke, during which the plunger is driven toward a suction side for suctioning the fuel into the pressurizing chamber;

the controller is configured to place the control valve in a closing state where the control valve closes the connection at a closing timing in a delivery stroke, during which the plunger is driven toward a delivery side for delivering the fuel out of the pressurizing chamber upon pressurization of the fuel after the suction stroke;

the controller is configured to maintain the control valve in the opening state to relieve the fuel, which is pressurized by the plunger, from the pressurizing chamber to the cam receiving chamber through the connection and the release passage during the delivery stroke until the closing timing reaches after a start of the delivery stroke;

the release passage is communicated with the suction passage through the connection; and the connection is configured to conduct the fuel from the pressurizing chamber to the release passage and thereafter to the cam receiving chamber in a case where a fuel pressure in the pressurizing chamber is higher than a fuel pressure in the cam receiving chamber in the opening state of the control valve.

2. The high pressure fuel pump according to claim 1, wherein:

the pump body forms a drain passage that drains the fuel from the cam receiving chamber to a fuel tank.

3. The high pressure fuel pump according to claim 2, wherein:

a passage cross-sectional area of a portion of the release passage is reduced on a side of the cam receiving chamber, at which the suction passage is placed, to form a release flow restricting portion; and a passage cross-sectional area of at least a portion of the drain passage is reduced in comparison to a passage cross-sectional area of the release flow restricting portion.

4. The high pressure fuel pump according to claim 1, wherein the connection is configured to conduct the fuel from the release passage to the pressurizing chamber in a case where the fuel pressure in the pressurizing chamber is lower than the fuel pressure in the cam receiving chamber in the opening state of the control valve.

5. The high pressure fuel pump according to claim 1, wherein the connection is located only on one axial side of the pressurizing chamber which is opposite to the plunger in an axial direction of the plunger.

6. A high pressure fuel pump for delivering fuel, which is suctioned into a pressurizing chamber from a low pressure fuel pump through a suction passage, to a supply destination after pressurizing the fuel in the pressurizing chamber with a plunger, the high pressure fuel pump comprising:

a pump body that slidably supports the plunger and forms the suction passage, the pressurizing chamber, a cam receiving chamber, a release passage, an internal pressure variable chamber and a communication passage, wherein the pressurizing chamber is communicated with the suction passage and the release passage through a connection, and the release passage is communicated with the cam receiving chamber which receives a drive cam that is configured to drive the plunger, and an internal pressure of the internal pressure variable chamber is increased and decreased in response to reciprocation of the plunger, and the communication passage communicates between the internal pressure variable chamber and the cam receiving chamber;

a control valve that is configured to open and close the connection; and a controller that is configured to control an operation of the control valve, wherein:

the controller is configured to place the control valve in an opening state where the control valve opens the connection to supply the fuel from the suction passage to the pressurizing chamber through the connection in a suction stroke, during which the plunger is driven toward a suction side for suctioning the fuel into the pressurizing chamber;

the controller is configured to place the control valve in a closing state where the control valve closes the connection at a closing timing in a delivery stroke, during which the plunger is driven toward a delivery side for delivering the fuel out of the pressurizing chamber upon pressurization of the fuel after the suction stroke;

the controller is configured to maintain the control valve in the opening state to relieve the fuel, which is pressurized by the plunger, from the pressurizing chamber to the cam receiving chamber through the connection and the release passage during the delivery stroke until the closing timing reaches after a start of the delivery stroke;

the pump body forms a drain passage that drains the fuel from the cam receiving chamber to a fuel tank;

a passage cross-sectional area of a portion of the release passage is reduced on a side of the cam receiving chamber, at which the suction passage is placed, to form a release flow restricting portion; and a passage cross-sectional area of at least-a portion of the drain passage is reduced in comparison to a passage cross-sectional area of the release flow restricting portion.

* * * * *